US008051594B2

(12) United States Patent
Carr et al.

(10) Patent No.: US 8,051,594 B2
(45) **Date of Patent: *Nov. 8, 2011**

(54) COMPACT FOLDABLE HANDGUN

(75) Inventors: Larry L. Carr, Chardon, OH (US); Douglas L. Carr, Chardon, OH (US); Trent A. Warncke, Lebanon, OH (US)

(73) Assignee: Covert Arms Ltd., Chardon, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/092,192

(22) Filed: Apr. 22, 2011

(65) Prior Publication Data

US 2011/0197488 A1 Aug. 18, 2011

Related U.S. Application Data

(63) Continuation of application No. 12/479,024, filed on Jun. 5, 2009, now Pat. No. 7,941,956.

(60) Provisional application No. 61/162,773, filed on Mar. 24, 2009.

(51) Int. Cl.
*F41A 11/04* (2006.01)

(52) U.S. Cl. ..... 42/73

(58) Field of Classification Search ..... 42/73
See application file for complete search history.

(56) References Cited

U.S. PATENT DOCUMENTS

| | | | | |
|---|---|---|---|---|
| 680,243 | A | 8/1901 | Gioda | 42/7 |
| 889,279 | A | 6/1908 | Warnant | 89/196 |
| 896,496 | A | 8/1908 | Whiting | 89/138 |
| 970,307 | A | 9/1910 | Clement | 89/196 |
| 991,398 | A | 5/1911 | Walther | 89/196 |
| 1,176,254 | A | 3/1916 | Smith | 89/138 |
| 1,625,768 | A | 4/1923 | Barnes | 42/69.02 |
| 1,454,454 | A | 5/1923 | Rosier | 42/59 |
| 1,711,874 | A | 5/1929 | Brinkerhoff | 42/69.03 |
| 2,141,537 | A | 12/1938 | Laloux | 42/75.01 |
| 3,242,840 | A | 3/1966 | Kremp et al. | 396/424 |
| 3,619,930 | A | 11/1971 | Beermann et al. | 42/69.01 |
| 3,683,537 | A | 8/1972 | Silva | 42/69.01 |
| 3,740,885 | A | 6/1973 | Leaman | 42/58 |
| 3,949,508 | A | 4/1976 | Elkas | 42/69 B |
| 3,979,850 | A | 9/1976 | Schiessl et al. | 42/71.02 |
| 4,015,512 | A | 4/1977 | Feerick | 89/190 |
| 4,299,046 | A | 11/1981 | Atchisson | 42/75.04 |
| 4,312,263 | A | 1/1982 | Bourlet | 89/154 |
| 4,625,621 | A | 12/1986 | Warin | 89/197 |
| 4,660,311 | A | 4/1987 | Breitfeld et al. | 42/72 |
| 4,667,429 | A | 5/1987 | Perazzi | 42/69.01 |
| 4,689,908 | A | 9/1987 | McClellan | 42/71.02 |
| 4,691,461 | A | 9/1987 | Behlert | 42/69.01 |
| 5,062,231 | A | 11/1991 | Braverman et al. | 42/1.09 |
| 5,115,588 | A | 5/1992 | Bronsart et al. | 42/69.02 |
| 5,131,317 | A | 7/1992 | Meller | 89/138 |

(Continued)

FOREIGN PATENT DOCUMENTS

FR 2811418 A1 1/2002

(Continued)

*Primary Examiner* — James Bergin
*Assistant Examiner* — Reginald Tillman, Jr.
(74) *Attorney, Agent, or Firm* — Kusner & Jaffe

(57) ABSTRACT

A handgun having a frame with a barrel. The barrel has a muzzle end and a breech end. A handgrip is attached to the frame to be pivotable relative to the frame and movable along the length of the frame.

10 Claims, 23 Drawing Sheets

U.S. PATENT DOCUMENTS

| | | | | |
|---|---|---|---|---|
| 5,179,233 | A | 1/1993 | du Plessis | 42/69.02 |
| 5,305,539 | A | 4/1994 | Von Kuster | 42/75.01 |
| 5,386,659 | A | 2/1995 | Vaid et al. | 42/69.02 |
| 5,421,114 | A | 6/1995 | Bond et al. | 42/42.03 |
| 5,666,754 | A | 9/1997 | de Oliveira Masina | 42/70.08 |
| 5,718,074 | A | 2/1998 | Keeney | 42/69.03 |
| 5,822,903 | A | 10/1998 | Davis, Sr. | 42/69.01 |
| 5,906,191 | A | 5/1999 | Wonisch et al. | 124/31 |
| 6,131,324 | A | 10/2000 | Jewell | 42/69.03 |
| 6,234,058 | B1 | 5/2001 | Morgado | 89/33.03 |
| 6,308,448 | B1 | 10/2001 | Kapusta et al. | 42/69.02 |
| 6,382,200 | B1 | 5/2002 | Levkov | 124/73 |
| 6,722,072 | B1 | 4/2004 | McCormick | 42/75.03 |
| 6,820,606 | B1 | 11/2004 | Duffey | 124/31 |
| 7,140,141 | B2 | 11/2006 | Vaid | 42/108 |
| 7,194,833 | B1 | 3/2007 | Curry | 42/14 |
| 7,293,385 | B2 | 11/2007 | McCormick | 42/75.03 |
| 7,739,821 | B1 | 6/2010 | Hamme | 42/8 |
| 7,743,543 | B2 | 6/2010 | Karagias | 42/69.02 |
| 7,941,954 | B2 | 5/2011 | Carr et al. | 42/73 |
| 7,941,956 | B2 * | 5/2011 | Carr et al. | 42/73 |
| 7,941,957 | B2 | 5/2011 | Carr et al. | 42/73 |
| 2007/0079539 | A1 | 4/2007 | Karagias | 42/69.02 |
| 2009/0277066 | A1 | 11/2009 | Burt et al. | 42/6 |

FOREIGN PATENT DOCUMENTS

| | | |
|---|---|---|
| RU | 2000538 C | 9/1993 |

* cited by examiner

COMPACT FOLDABLE HANDGUN

This application is a continuation of U.S. application Ser. No. 12/479,024 (filed Jun. 5, 2009) now U.S. Pat. No. 7,941,956, which claims the benefit of U.S. Provisional Application No. 61/162,773 (filed Mar. 24, 2009).

FIELD OF THE INVENTION

The present invention relates generally to firearms and, more particularly, to a handgun that is foldable into a compact storage configuration.

BACKGROUND OF THE INVENTION

Most states of the United States have Right to Carry (RTC) Laws that enable its citizens to carry concealed handguns. A main reason for carrying a concealed handgun is self-defense. Most RTC permit holders desire a firearm having sufficient caliber and firepower to stop a potential attacker or aggressor in life-threatening situations. At the same time, it is likewise desirable to have a firearm that is relatively small and compact so that it can be worn in a comfortable and unobtrusive manner. Even law-enforcement officers, such as policemen and security officers, have a need for a back-up weapon that can be worn undetected on the body.

Most pistols of a caliber sufficient for use in personal protection or by a law-enforcement officer are relatively large because of the traditional L-shape of conventional handguns. As such, conventional handguns cannot be comfortably worn in a concealed fashion. Smaller pistols have been designed to address the desire for a more concealable weapon. But smaller pistols still have the traditional L-shaped configuration, and as the size of a pistol is reduced, the number of shells the gun can carry is also reduced. Still further, as the size of a pistol gets smaller, so does the size of the handgrip. Smaller handgrips make holding a pistol uncomfortable and awkward because a smaller handgrip cannot accommodate all the fingers of an average person's hand.

The present invention overcomes these and other problems and provides a pistol having a handgrip that is movable relative to the barrel of the pistol into a compact storage configuration that can be easily worn in an unobtrusive manner.

SUMMARY OF THE INVENTION

In accordance with a preferred embodiment of the present invention, there is provided a handgun having a frame with a barrel. The barrel has a muzzle end and a breech end. A handgrip is mounted to the frame to pivot about an axis. The handgrip is movable between a firing position and a storage position. The axis is movable relative to the frame along a path extending in a direction of the barrel wherein the handgrip is movable along the length of the frame to the storage position wherein the handgrip is adjacent the frame.

In accordance with another aspect of the present invention, there is provided a handgun comprised of a frame having a first end and a second end. The frame has a barrel with a muzzle end and a breech end. A slide is movable on the frame between one of a firing position and a blow-back position. A handgrip has a proximal end adjacent the frame and a distal end. The handgrip is pinned to the frame for movement relative thereto. The handgrip is movable between a firing position and a storage position. The handgrip is oriented adjacent and generally parallel to the frame with the proximal and distal ends of the handgrip disposed respectively adjacent the first end and the second end of the frame when the handgrip is in the storage position.

In accordance with another aspect of the present invention, there is provided a handgun comprised of a frame having a barrel. The barrel has a muzzle end and a breech end. A handgrip is attached to the frame. The handgrip is pivotable relative to the frame and movable along the frame in a direction aligned with the barrel.

In accordance with yet another aspect of the present invention, there is provided a derringer, comprised of a frame having at least one barrel. The barrel has a muzzle end and a breech end. A handgrip is mounted to the frame to pivot about an axis. The handgrip is movable between a firing position and a position where the handgrip is generally adjacent the frame. The axis is movable relative to the frame along a path extending in a direction of the barrel wherein the handgrip is movable along the length of the frame to a storage position adjacent the frame.

An advantage of the present invention is a foldable gun that does not resemble or suggest the appearance of a handgun when in a storage position.

Another advantage of the present invention is a handgun that is collapsible for compact storage.

Another advantage of the present invention is a handgun, as described above, that is collapsible to a small profile.

Another advantage of the present invention is a handgun, as described above, having a handgrip that is pivotable relative to the barrel of the gun and is also movable along a path that extends along the barrel.

Another advantage of the present invention is a handgun, as described above, wherein the handgrip is pivotable relative to the barrel of the gun between an operating position and a storage position.

A still further advantage of the present invention is a handgun that can be quickly and easily moved from a storage position to an operating position so as to be immediately operable by the user.

Another advantage of the present invention is a handgun, as described above, that can be moved between a storage position and an operating position with minimum effort.

Another advantage of the present invention is a handgun having a slide reciprocally movable on a frame, wherein a shell may be loaded into the barrel of the gun or extracted therefrom without moving the slide.

Another advantage of the present invention is a handgun as described above having a movable slide with a hatch that is movable between an open position and an operational position.

Another advantage of the present invention is a handgun as described above, wherein the hatch is locked into said operational position when the handgun is fired.

Another advantage of the present invention is a handgun as described above, wherein a firing pin is disposed in the movable hatch.

A still further advantage of the present invention is a firing pin locking device disposed in the hatch.

A still further advantage of the present invention is a handgun as described above having a trigger that is movable to a storage position within the frame of the handgun.

A still further advantage of the present invention is a handgun as described above having a trigger guard that is movable to a storage position within the frame of the handgun.

A still further advantage of the present invention is a handgun as described above having a two-section trigger guard that is collapsible to a storage position.

A still further advantage of the present invention is a handgun that is collapsible to a small profile, yet is capable of holding a relatively large number of shells.

A still further advantage of the present invention is a handgun that is collapsible to a small profile, yet still has a handle that can be gripped and held by all the fingers on an average person's hand.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, preferred embodiments of which shall be described in detail in the specification and illustrated in the accompanying drawings which form a part hereof, and wherein.

DETAILED DESCRIPTION OF PREFERRED EMBODIMENT

Figure 1:
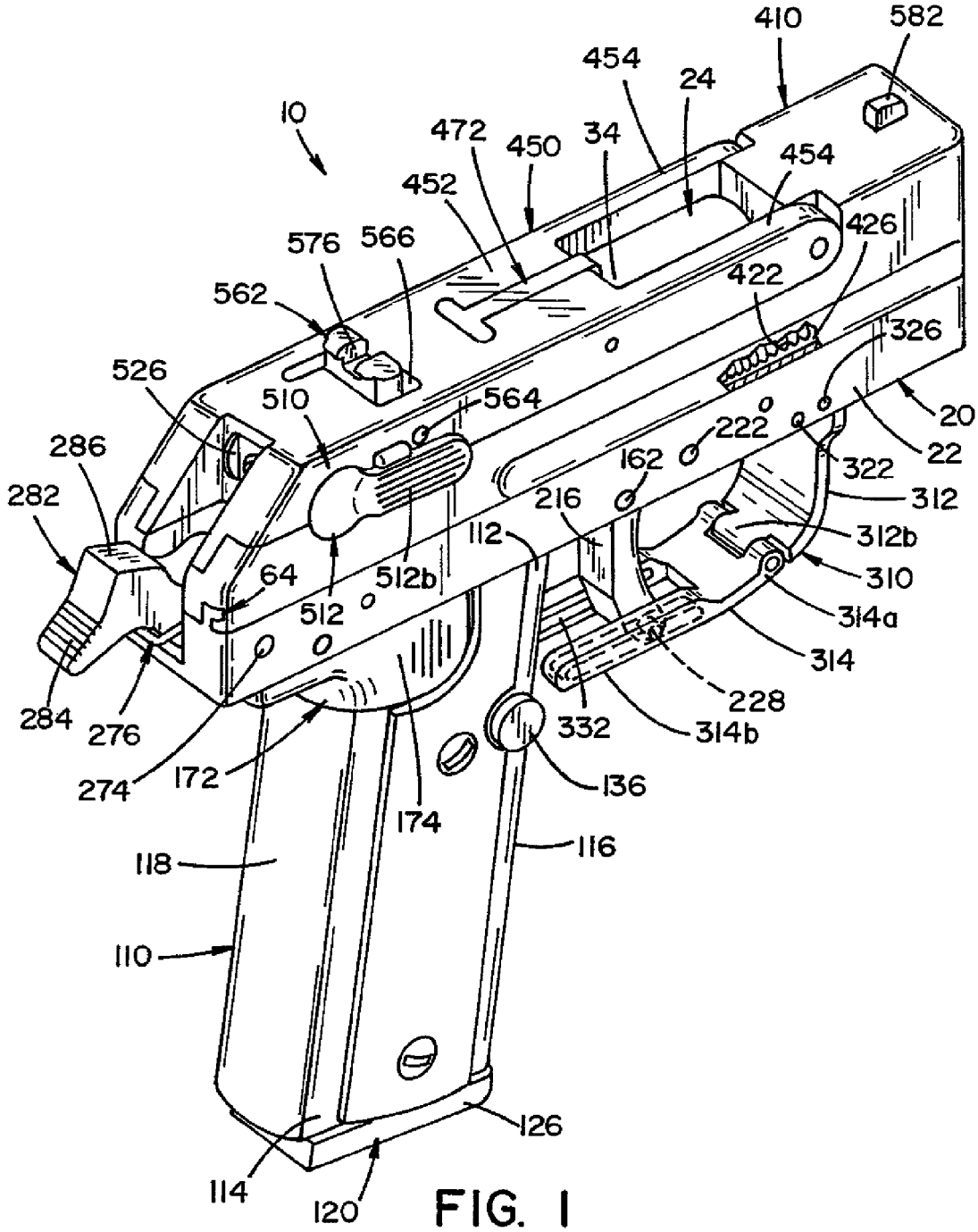
FIG. 1 is a top perspective view of a pistol, illustrating a preferred embodiment of the present invention.

Referring now to the drawings wherein the showings are for the purpose of illustrating preferred embodiments of the invention only and not for the purpose of limiting same, FIG. 1 shows a pistol 10 illustrating a preferred embodiment of the present invention. Broadly stated, pistol 10 is comprised of a frame 20, a handgrip 110 with a removable magazine 120, a firing assembly 210, a trigger guard assembly 310, and a slide 410 with an openable hatch 450.

Figure 6:
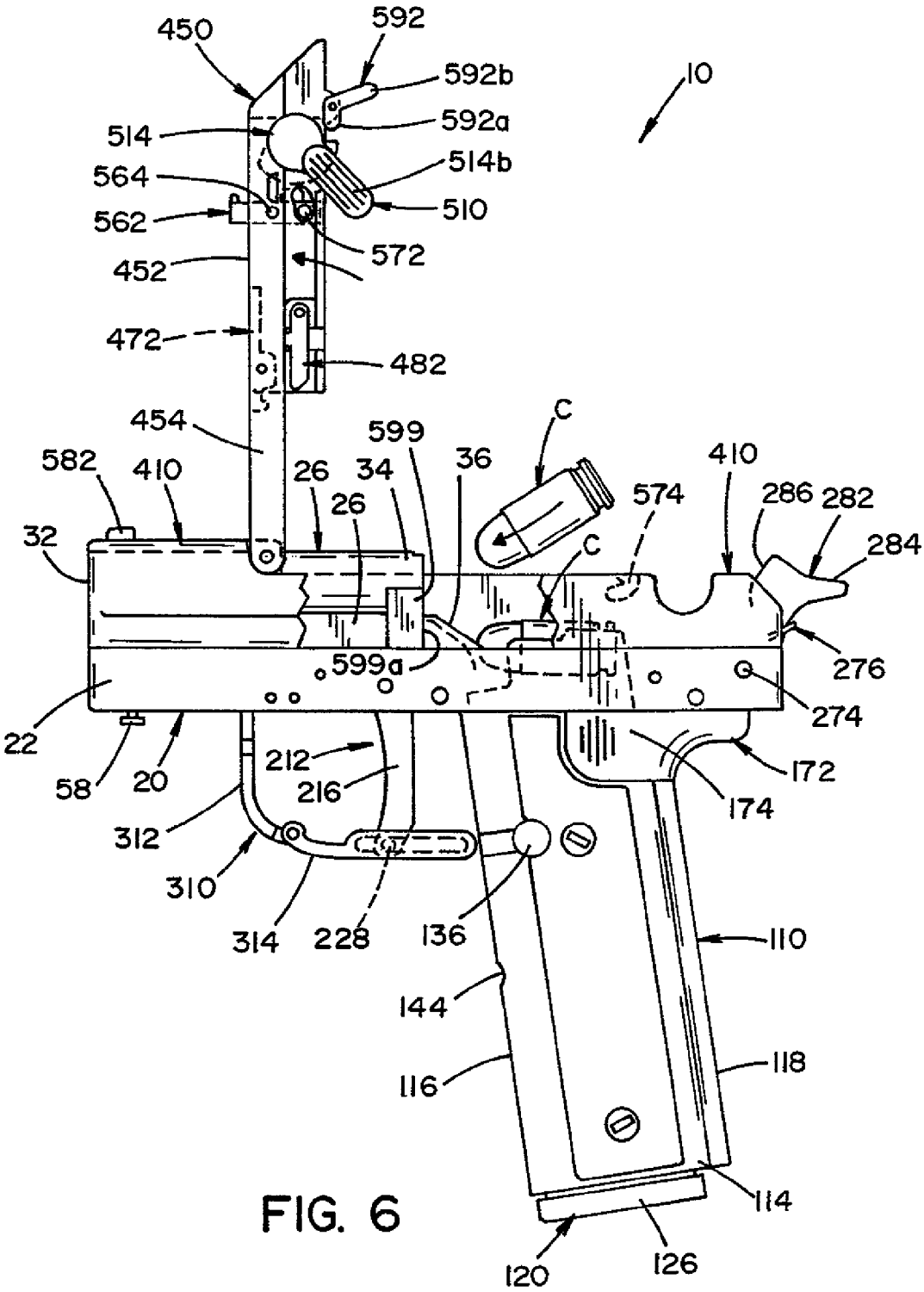
FIG. 6 is a side elevational, partially-sectioned view of the pistol showing a shell being loaded into the pistol through an opened hatch.

In the embodiment shown, frame 20 is an integrally formed member having an elongated, generally rectangular base 22. A barrel 24 is formed above one end of base 22. As best seen in FIG. 6, a wall 26 connects barrel 24 to base 22. Barrel 24 has a muzzle end 32 and a breech end 34. Hereinafter, the terms "front" or "front end" shall be used to describe pistol 10 and parts of pistol 10 that extend toward muzzle end 32 of barrel 24. The terms "aft," "aft-end," "rear" or "rear end" shall be used to describe pistol 10 and parts of pistol 10 that extend toward the back end of pistol 10. The rear end of wall 26 that connects barrel 24 to base 22 is formed to define a ramped surface 36 below breech end 34 of barrel 24. An opening 42, best seen in FIGS. 8A-8E, is formed through base 22 of frame 20 to communicate with ramped surface 36 to allow shells to be fed into barrel 24, as shall be described in greater detail below.

Figure 8A:
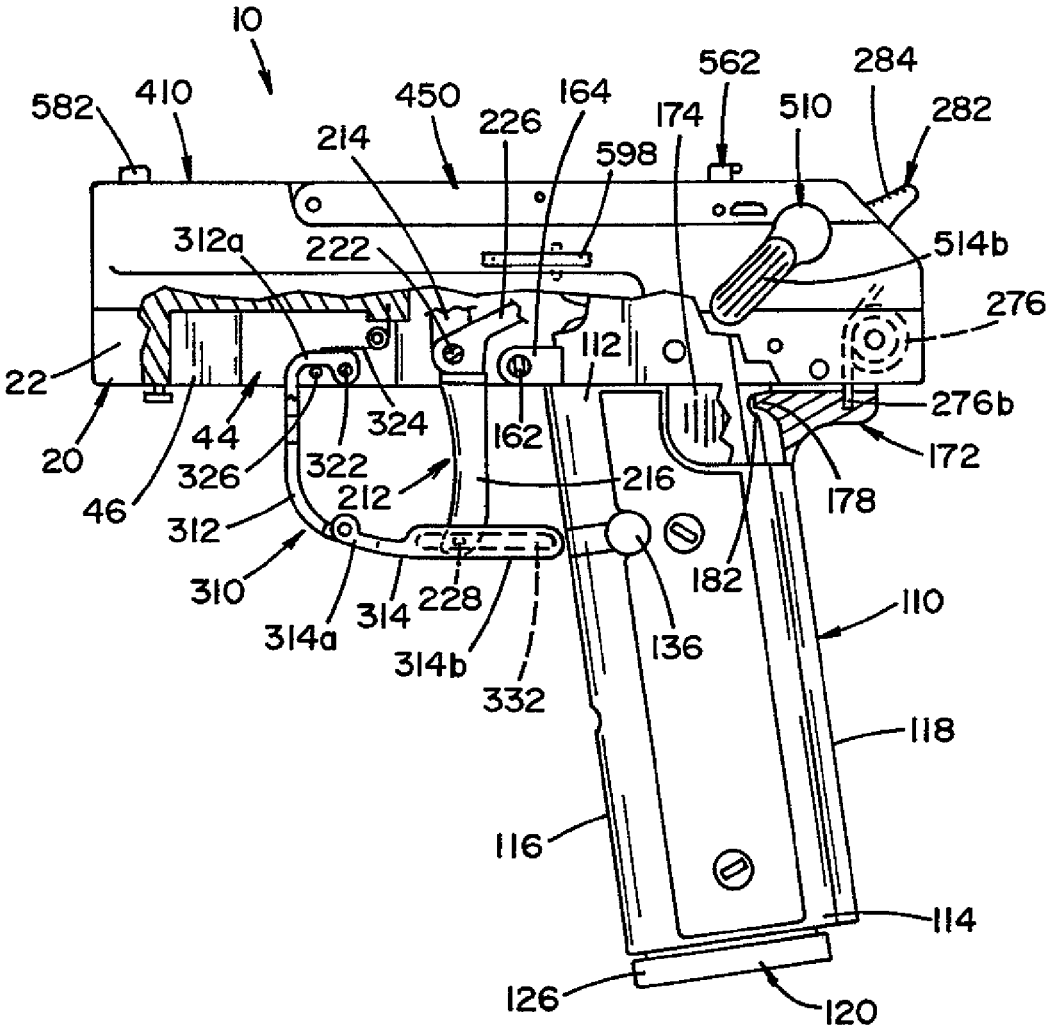
FIGS. 8A-8E are partially-sectioned, side elevation views of the pistol shown in FIG. 1, showing the pistol in various positions as the pistol is collapsed from the operational configuration to the storage configuration.
Figure 8B:
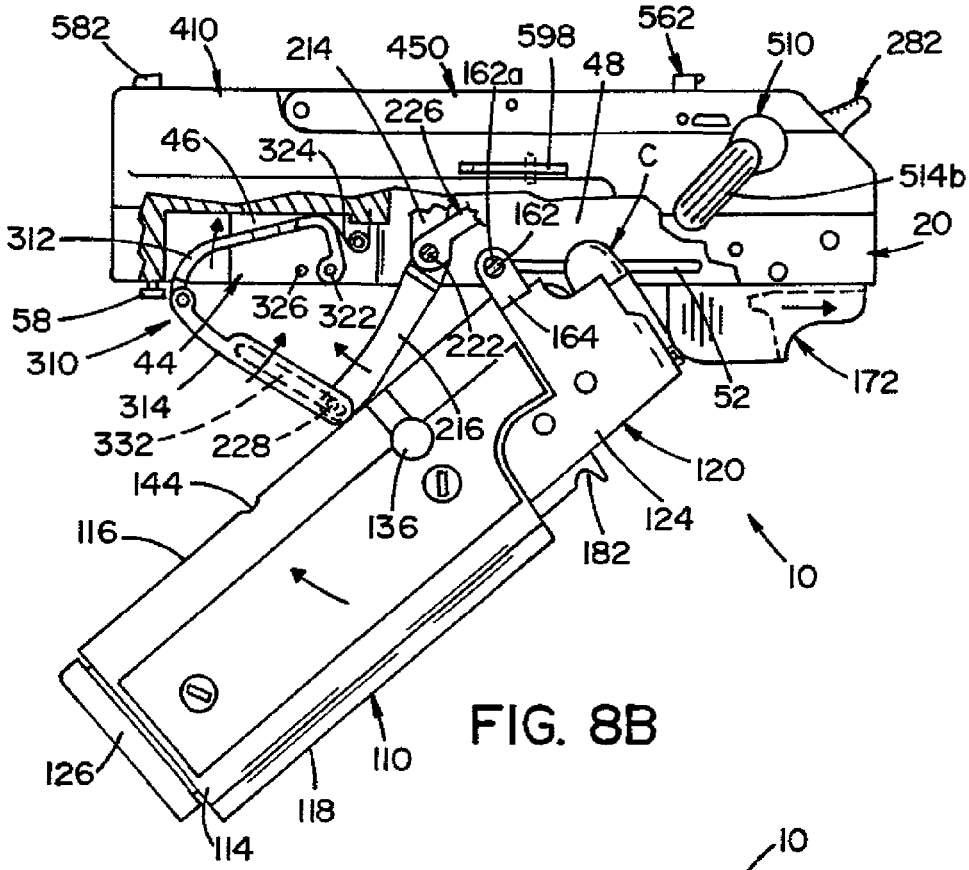
Figure 8C:
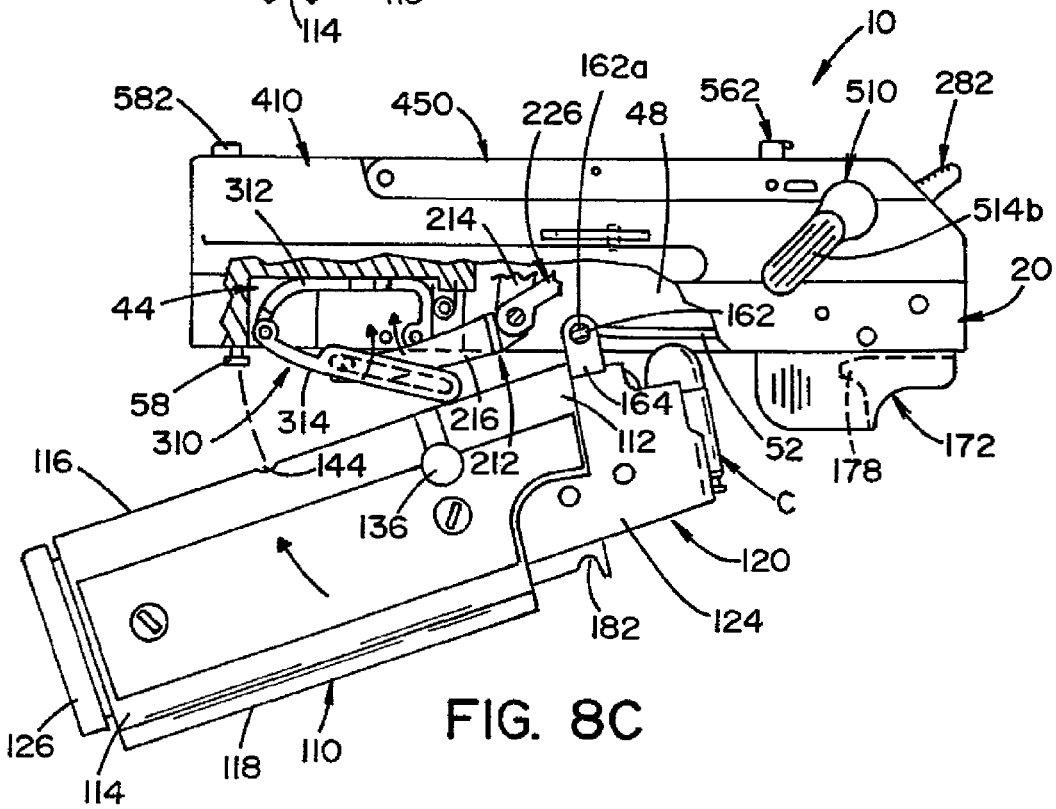
Figure 8D:
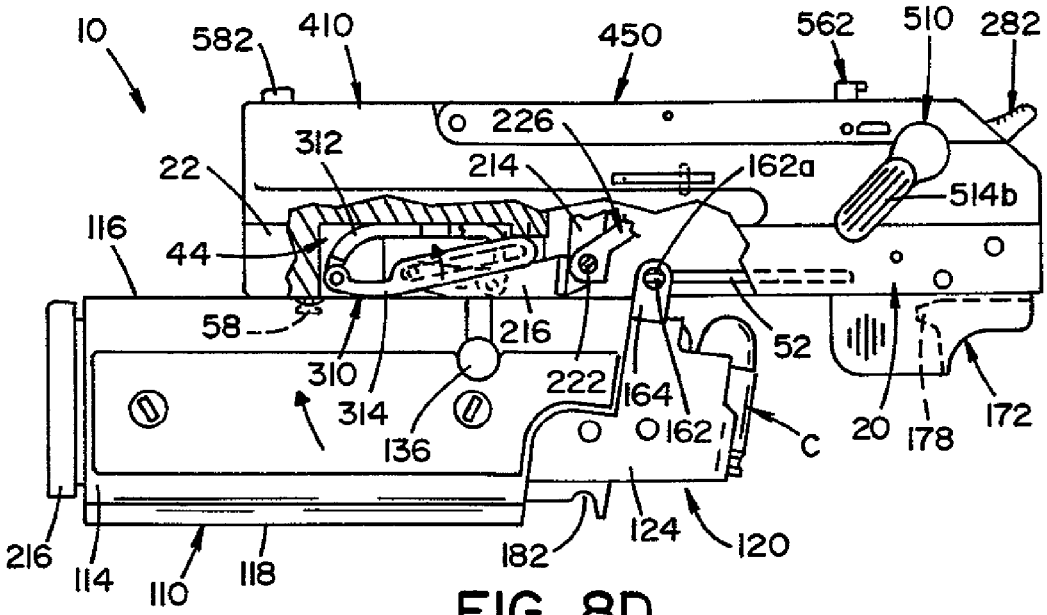
Figure 8E:
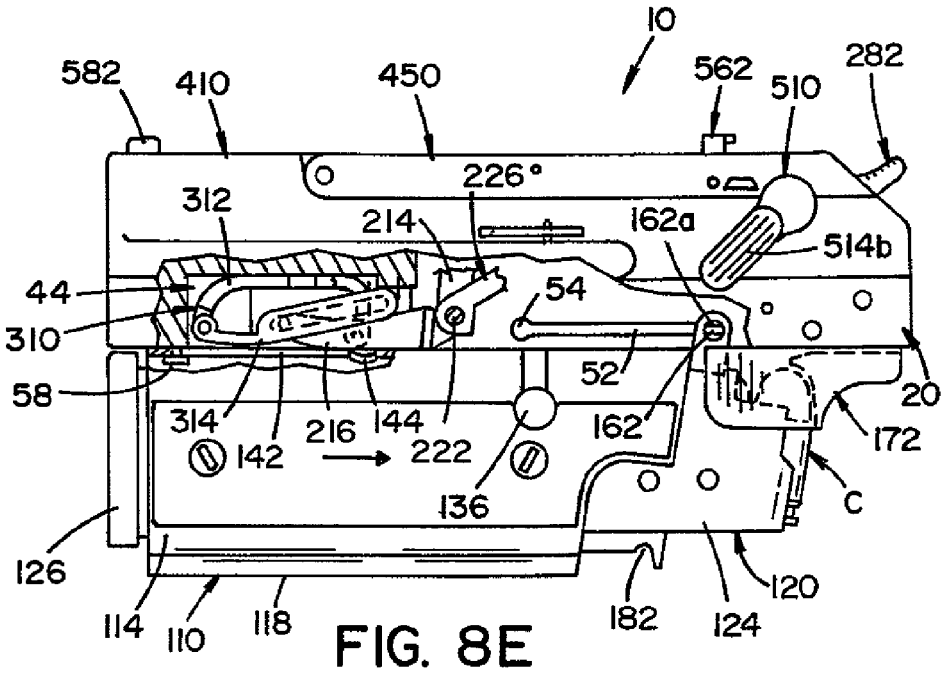

A cavity 44 extends along the underside of frame 20, as best seen in FIG. 2 and FIGS. 8A-8E. Cavity 44 is dimensioned to receive trigger guard assembly 310, portions of handgrip 110 and firing assembly 210, as shall be described in greater detail below. Cavity 44 defines a pair of spaced-apart side walls 46, 48 that extend along the lateral sides of frame 20. An elongated slot 52 is formed in the inner surface of each side wall 46, 48. FIGS. 8B-8E show slot 52 in side wall 48. Slots 52 oppose each other, and are disposed in side walls 46, 48 to be in registry with each other. In the embodiment shown, slots 52 are linear, straight slots. A circular opening 54, best seen in FIG. 8E, is formed at the front end of each slot 52. A pin 58, having an enlarged end extends downward from the underside of frame 20 at the front end thereof.

Figure 14:
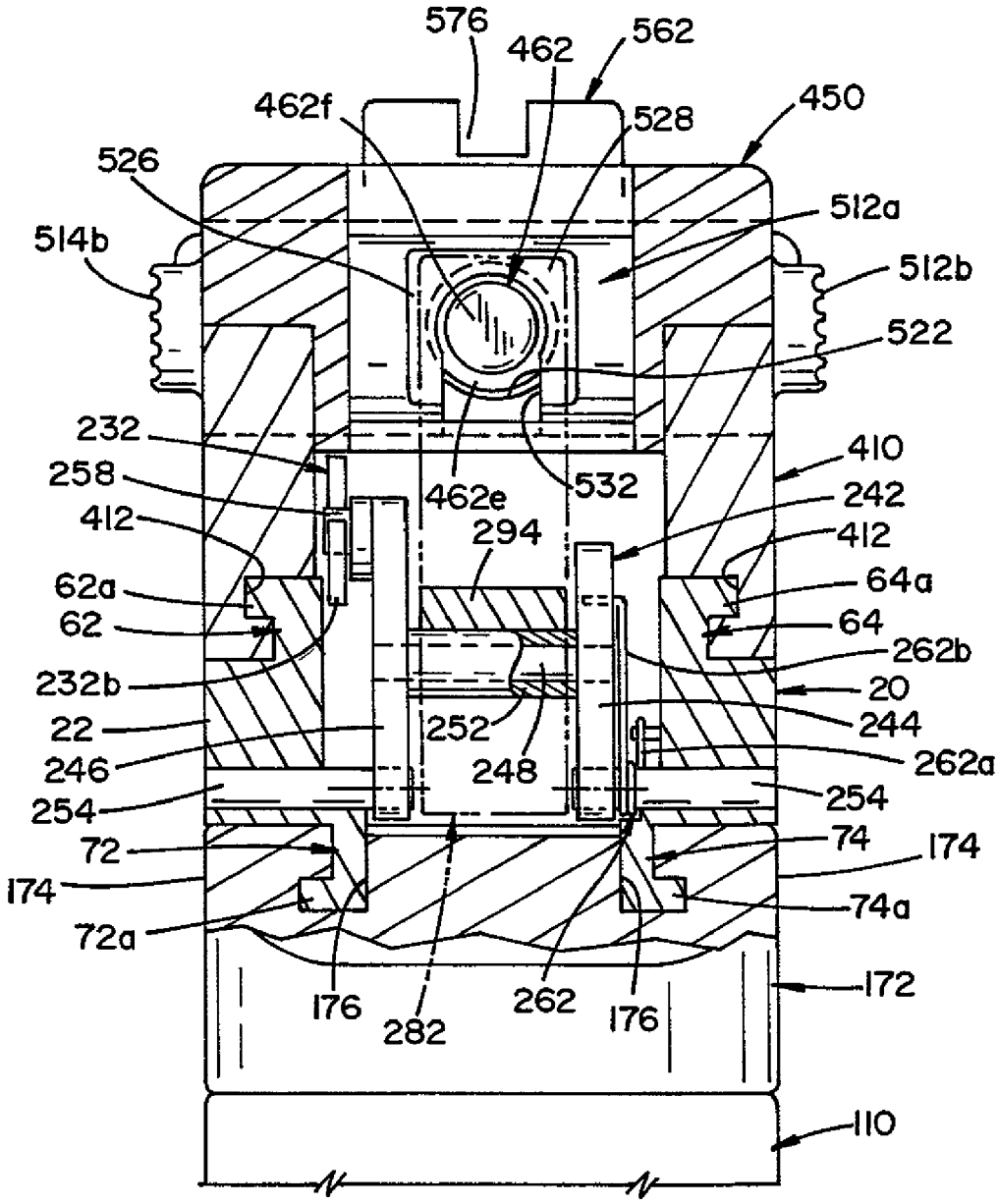
FIG. 14 is a sectional view taken along lines 14-14 of FIG. 11A.

A first set of spaced-apart rails 62, 64, best seen in FIG. 14, is formed along the upper surface of base 22 of frame 20.

Rails 62, 64 are generally L-shaped having laterally projecting leg portions 62*a*, 64*a*. Rails 62, 64 are mirror images of each other and extend longitudinally along the length of frame 20.

As also seen in FIG. 14, a second set of spaced-apart, parallel rails 72, 74 extends downwardly from the underside of frame 20. Rails 72, 74 are L-shaped with laterally projecting leg portions 72*a*, 74*b*. Rails 72, 74 are disposed at the aft end of frame 20.

Figure 5:
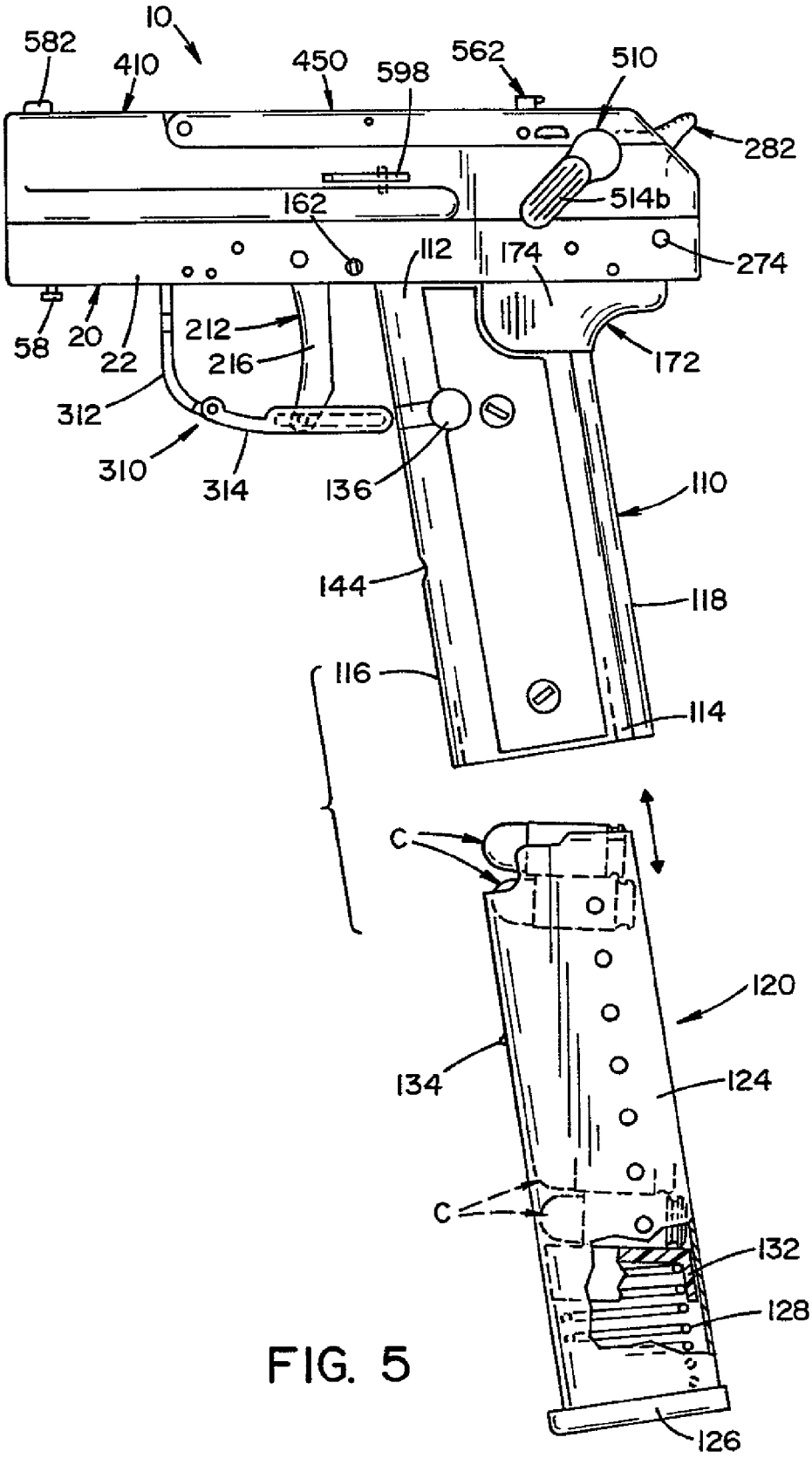
FIG. 5 is a side-elevational view of the pistol of FIG. 1 showing a cartridge magazine exploded therefrom.

Handgrip 110 is connected to frame 20. Handgrip 110 has a proximal end 112 for engaging frame 20 and a distal end 114. Handgrip 110 has a front or leading edge 116 and a back edge 118. Handgrip 110 is hollowed to define a magazine well to accommodate a cartridge-carrying magazine 120. In the embodiment shown, the magazine well opens to the exterior via an opening through distal end 114, i.e., the free end, of handgrip 110. Magazine 120, best seen in FIG. 5, includes a magazine body 124 having a magazine base 126 enclosing the lower portion thereof. Magazine body 124 is dimensioned to contain a plurality of cartridges (shells), designated "C" in the drawings. A magazine spring 128 biases a magazine follower 132 which forces cartridges C to the upper end of magazine body 124. A protrusion 134 on the front (leading) edge of magazine body 124 is dimensioned to interact with a magazine-retaining mechanism (not shown) within the magazine well in handgrip 110, as is conventionally known. A release button 136 is disposed on each side of handgrip 110 to facilitate release of magazine 120 from handgrip 110.

A T-shaped slot 142 extends along leading edge 116 of handgrip 110. A circular opening 144 is formed at one end of slot 142. Opening 144 is dimensioned to receive the enlarged end of pin 58, and slot 142 is dimensioned to allow the cylindrical body of pin 58 to slide therethrough with the enlarged end captured within slot 142.

Figure 11A:
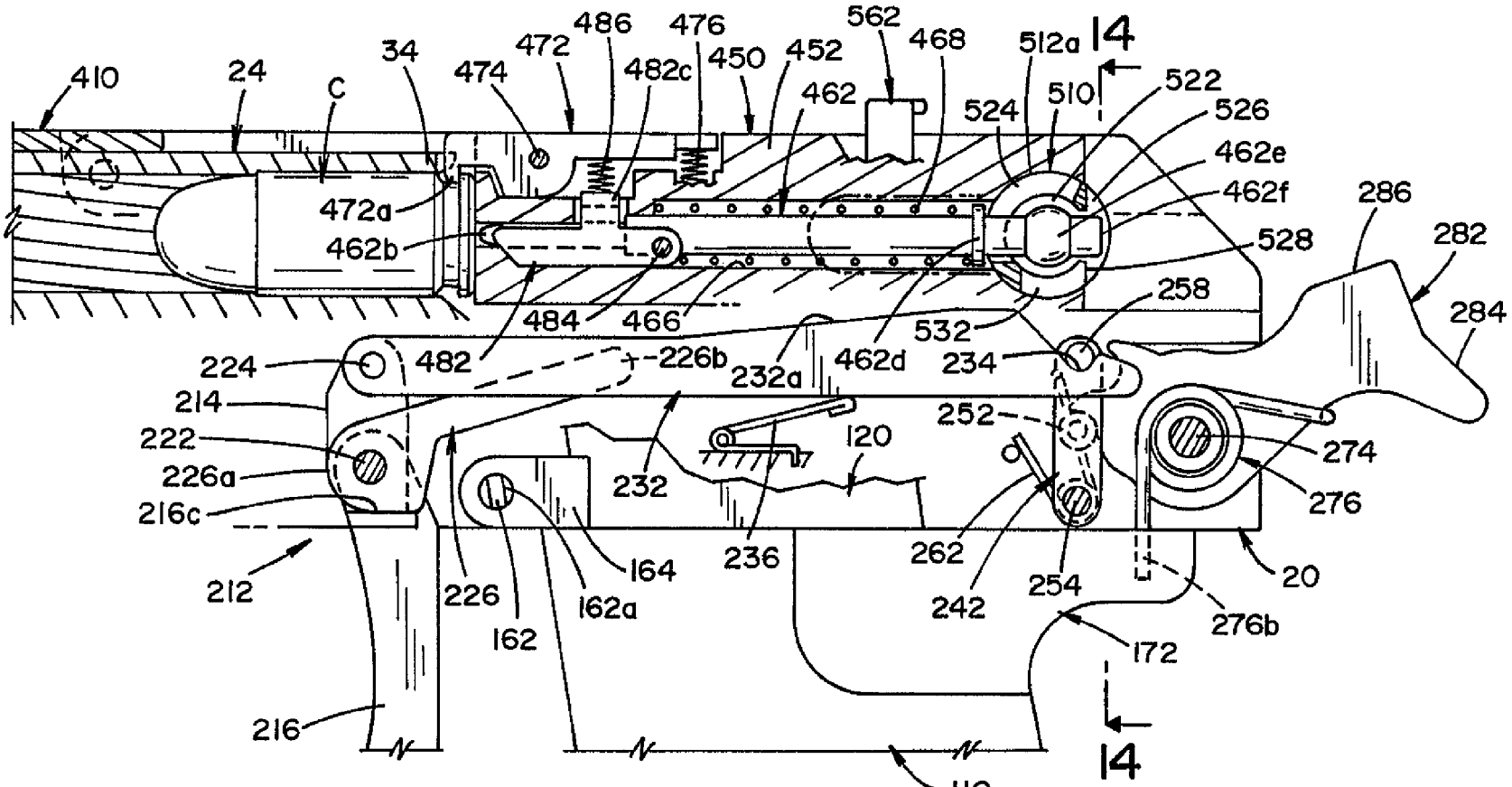
FIG. 11A is an enlarged, partially-sectioned, side view of a portion of the pistol shown in FIG. 1, showing the firing mechanism and a hammer in a "fully cocked" position.
Figure 11B:
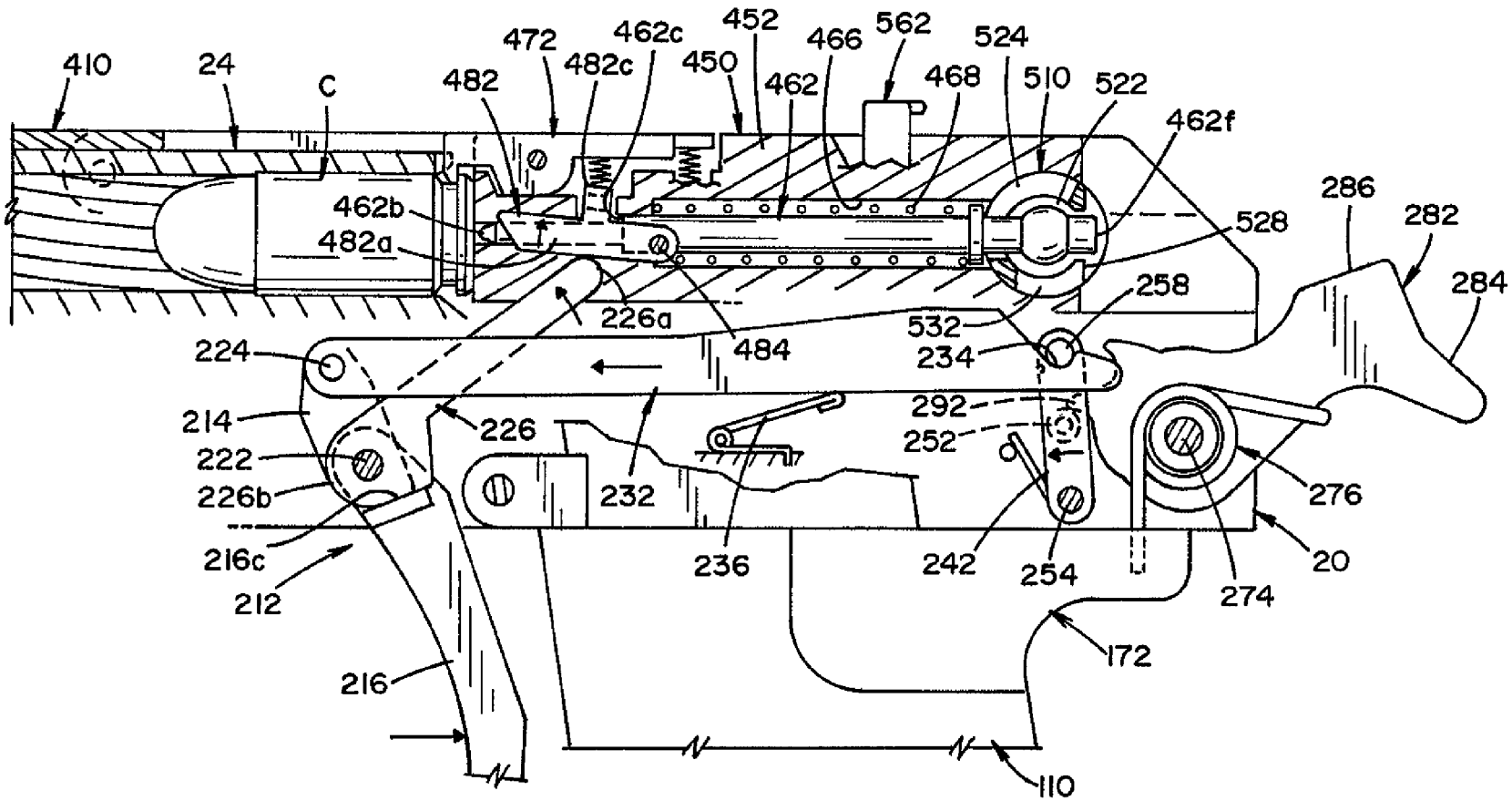
FIG. 11B is a side view showing the relative movement of parts of the firing mechanism as the trigger is depressed.

In accordance with one aspect of the present invention, handgrip 110 is pivotally mounted to frame 20. A pin 162 extends through a tab 164. Tab 164 projects forward from the front edge of proximal end 112 of handgrip 110, as best seen in FIGS. 8A-8E. Pin 162 is fixedly mounted to tab 164 to be rotatable therewith. A portion of pin 162 extends outwardly from each side of handgrip 110. Each end of pin 162 is machined to define a wall 162*a*, best seen in FIGS. 11A-12, having a wall thickness slightly less than the width of slots 52 in side walls 46, 48 of frame 20. The ends of pin 162 are dimensioned to be received in openings 54 that are formed at the end of slots 52 in side walls 46, 48 of frame 20. Because the ends of walls 162*a* are extensions of pin 162, i.e., have a radiused surface conforming to the cylindrical surface of pin 162, walls 162*a* are rotatable in circular opening 54, thereby allowing handgrip 110 to pivot about openings 54. As indicated above, slots 52 are straight and extend longitudinally along side walls 46, 48 of frame 20. In this respect, handgrip 110 is pivotable relative to the frame about a predetermined location, i.e., opening 54, on frame 20, and is movable longitudinally along the length of frame 20 when walls 162*a* on the ends of pin 162 align with slots 52 in side walls 46, 48.

As best seen in FIG. 8A, pin 162 on handgrip 110 and opening 54 at the end of slots 52 on frame 20 are disposed such that proximal end 112 of handgrip 110 abuts the lower end of frame 20, with the upper end of magazine 120 extending through opening 42 in base 22 of frame 20 so as to position the uppermost cartridge C adjacent to ramped surface 36 on frame 20.

Figure 2:
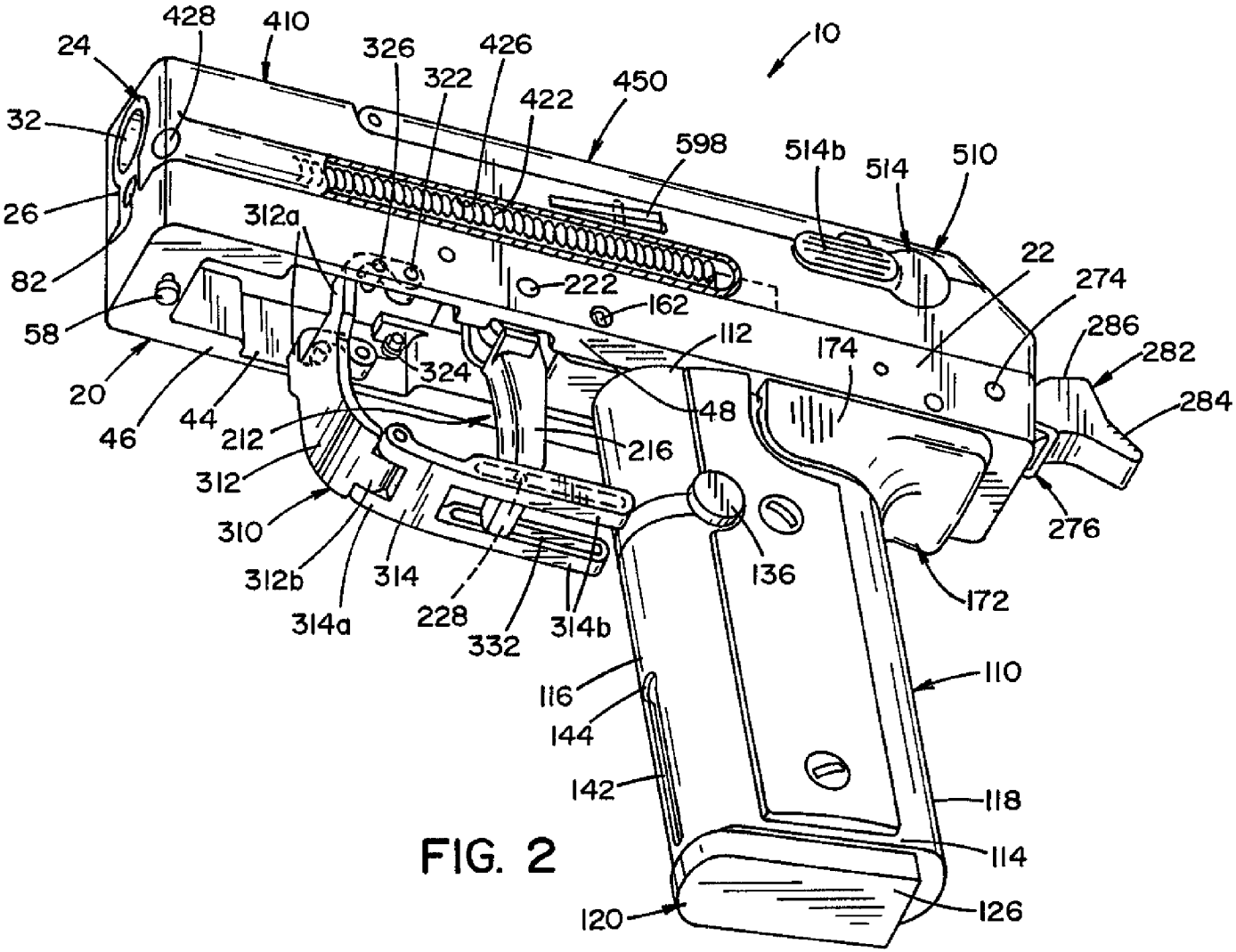
FIG. 2 is a bottom perspective view of the pistol shown in FIG. 1.
Figure 3:
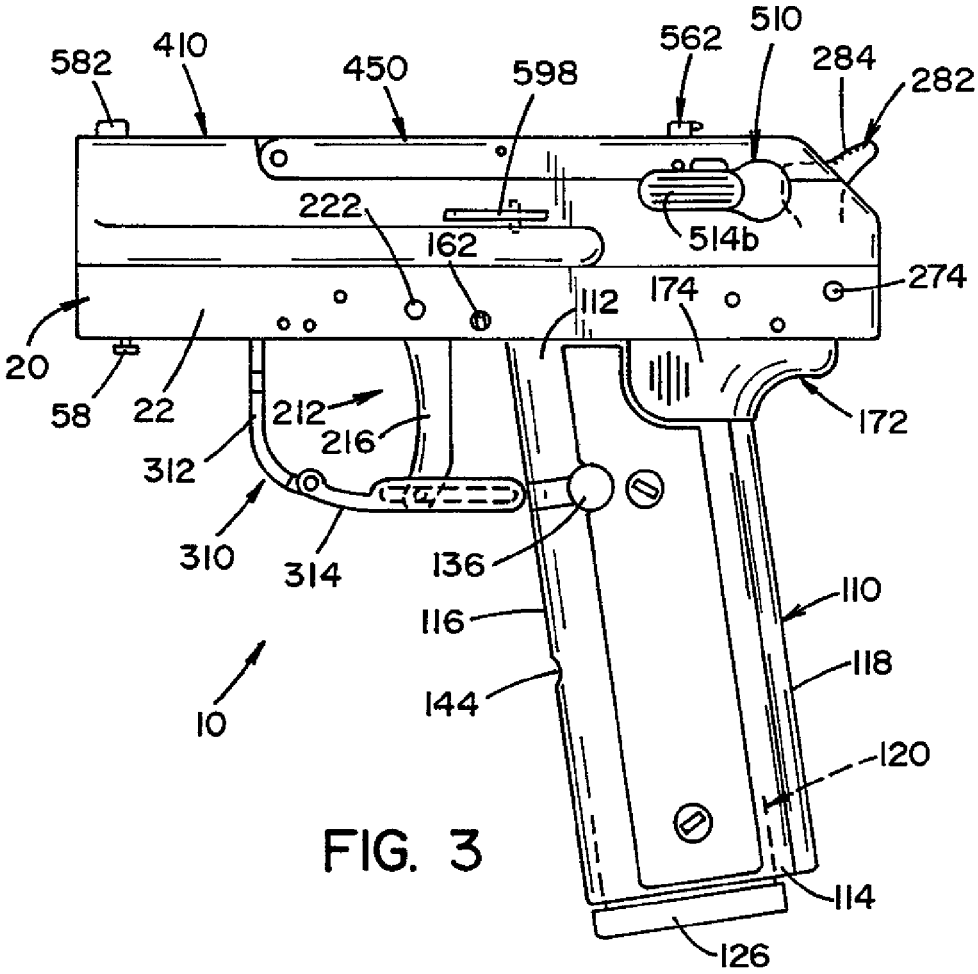
FIG. 3 is a side-elevational view showing the pistol of FIG. 1 in an operational configuration.
Figure 4:
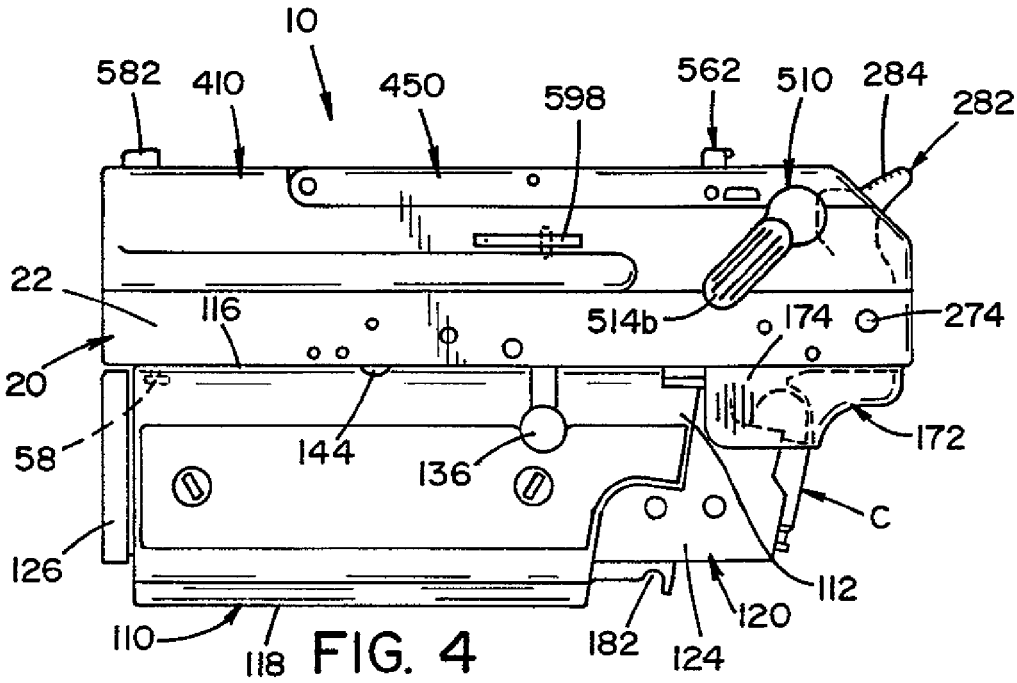
FIG. 4 is a side-elevational view showing the pistol of FIG. 1 in a storage configuration.

The slot-and-pin configuration heretofore described allows handgrip 110 to be pivotable about a pivot axis relative to frame 20, and then slide along the length of frame 20. As shall be described in greater detail below, the pinned connection between handgrip 110 and frame 20 allows handgrip 110 to be moved between an operational position, as shown in FIGS. 1-3, 5 and 8A, and a storage position, as shown in FIGS. 4 and 8E.

The slot-and-pin configuration heretofore described, limits rotation of handgrip 110 about a specific location, i.e., openings 54, because of the design and dimensions of walls 162*a* on the ends of pin 162 and the dimension of openings 54 and slots 52. It is contemplated that pin 162 could be cylindrical, i.e., without machined walls 162*a* at the ends thereof, and be received in slots 52 that are slightly larger than pin 162, wherein handgrip 110 could pivot about pin 162 at any location along slots 52. In this latter configuration, the forwardmost end of slots 52 could be used to position the ends of handgrip 110 in relation to frame 20 when in the operating position. This latter configuration would allow handgrip 110 to have a pivot axis relative to frame 20, wherein the location of the pivot axis is movable along frame 20.

A locking collar 172 is attached to frame 20 to lock handgrip 110 in the operational position. As viewed from above, locking collar 172 is a generally U-shaped element and has side walls 174 that are spaced-apart and dimensioned to receive back edge 118 of handgrip 110 near proximal end 112. As shown in the drawings, collar 172 is shaped to mate with the contour of handgrip 110. Collar 172 includes two spaced-apart, L-shaped slots 176 that are dimensioned to receive rails 74, as best seen in FIG. 14, such that collar 172 is slidably mounted to frame 20. Legs 276*b* of biasing spring 276 bias locking collar 172 in a forward direction. As indicated above, locking collar 172 is designed to mate with back edge 118 of handgrip 110. A tab 178, best seen in FIG. 8A, extends from the inner surface of locking collar 172. Tab 178 is received within a notch 182, best seen in FIGS. 8B-8E, that is formed in handgrip 110. When locking collar 172 is in a forward position, notch 182 in handgrip 110 captures tab 178 on locking collar 172, thereby preventing handgrip 110 from being rotated while in an operational position, about the pivot axis. As best seen in FIGS. 2 and 3, locking collar 172 is contoured to provide a mating, nesting surface, conventionally referred to as a "beaver tail," for a user's hand, specifically, the portion of the hand between the thumb and forefinger.

A firing assembly 210, best seen in FIGS. 9 and 11A-11E, is mounted in frame 20. Firing assembly 210 basically includes a two-piece trigger 212, a trigger bar 232, a sear assembly 242, and a spring-activated hammer 282. Trigger 212 includes an upper trigger section 214 and a lower trigger section 216. The lower end of upper trigger section 214 is connected to the upper end of lower trigger section 216 by a pivot pin 222 that extends between side walls 46, 48 of frame 20. Upper trigger section 214 and lower trigger section 216 are designed such that upper and lower trigger sections 214, 216 rotate together (as one) when lower trigger section 216 is depressed, i.e., pulled toward the aft end of pistol 10. Lower trigger section 216 is pivotable about upper trigger section 214 when lower trigger section 216 is moved in a forward direction.

Figure 9:
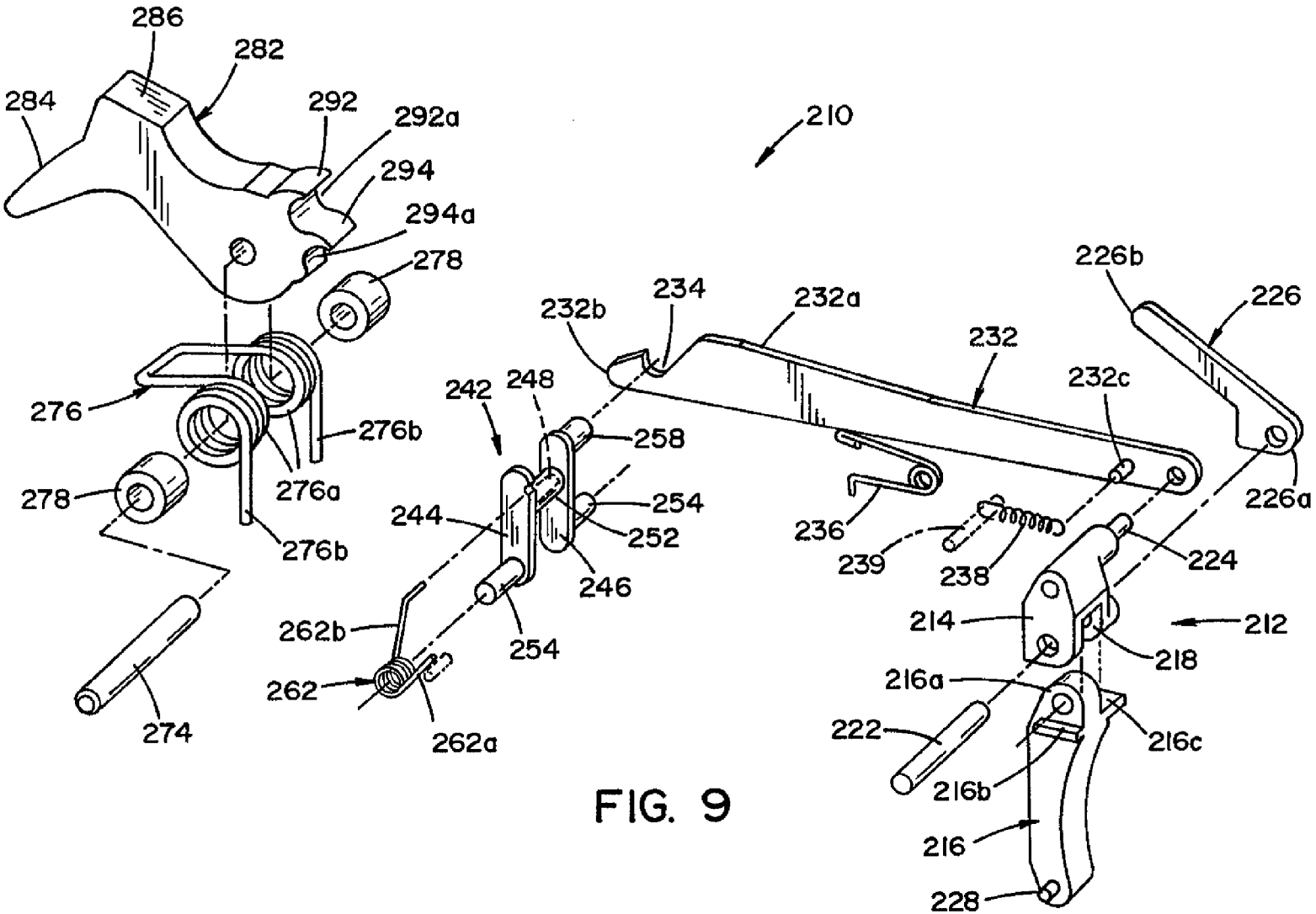
FIG. 9 is an exploded view of a firing mechanism for the pistol shown in FIG. 1.

In the embodiment shown, a rounded projection 216*a* on the upper end of lower trigger section 216 is received in a slot 218 in upper trigger section 214. The lower end of the upper trigger section 214 is flat and is designed to engage flat, upwardly-facing surfaces on projections 216*b*, 216*c* that extend from the sides of lower trigger section 216. The lower, front end of upper trigger section 214 is radiused, as shown in FIG. 9. The lower back end of upper trigger section 214 has a squared corner. In this respect, the radiused portion on upper trigger section 214 allows the projections 216*b*, 216*c* on lower trigger section 216 to slide over and around the radiused portion of upper trigger section 214 and move to the front of upper trigger section 214. In contrast, if lower trigger section 216 is depressed, the squared corner of upper trigger section 214 prevents relative movement between the upper trigger section 214 and lower trigger section 216, causing both sections 214, 216 to move together about pivot pin 222. A pin 228 extends outwardly from each side of lower trigger section 216. Pins 228 are axially aligned and are disposed at the lower end of lower trigger section 216, as shown in FIG. 9.

Upper trigger section 214 includes a laterally-extending pin 224 that pivotally connects upper trigger section 214 to one end, i.e., the front end, of trigger bar 232. Movement of upper trigger section 214 causes trigger bar 232 to move laterally within frame 20. Trigger bar 232 is an elongated member having an upwardly-facing notch 234 at the rear end thereof. Notch 234 of trigger bar 232 is dimensioned to operatively engage a sear 242, best seen in FIG. 9. Trigger bar 232 has an upper surface 232*a* that is tapered to engage slide 410 during a firing operation. Trigger bar 232 has a rounded back end 232*b*. A torsion spring 236, that is attached to frame 20 (not shown) biases trigger bar 232 in an upward direction. A torsion spring 238 is attached at one end to a pin 232*c* on trigger bar 232. The other end of torsion spring 238 is attached to a pin 239 that is mounted to frame 20. Extension spring 238 biases trigger bar 232 in a rearward direction.

An actuator 226 is provided to operatively engage and interact with lower trigger section 216. Actuator 226 is an elongated element having a first end 226*a* and a second end 226*b*. First end 226*a* is pivotally mounted at one end to trigger pin 222. Second end or free end 226*b*, of actuator 226 extends upward and backward toward the rear end of pistol 10. The bottom surface of first end 226*a* of actuator 226 is designed to engage the upward facing flat surface of projection 216*c* on lower trigger section 216*c* such that as lower trigger section 216 is depressed, i.e., is moved rearward, actuator 226 rotates about trigger pin 222 and free end 226*b* of actuator 226 moves upward.

Sear 242 includes two, spaced-apart frame members 244, 246. A pin 248, best seen in FIG. 15, connects frame member 244 to frame member 246. In accordance with one aspect of the present invention, a tubular, roller member 252 is axially mounted on pin 248 to be rotatable thereon. Tubular roller 252 may be formed of a metal, polymer or ceramic material. In one embodiment, roller 252 is formed of a hard, tough plastic material. The outer surface of roller 252 defines a hammer-engagement surface adapted to engage hammer 282.

The lower end of each frame member 244, 246 includes an outwardly extending pin 254. Pins 254 are axially aligned and extend into bores (not shown) in frame 20 such that sear 242 is pivotally mounted to frame 20. A pin 258 extends outwardly from the upper end of frame member 246. Pin 258 defines a trigger-bar-engagement surface adapted to engage trigger bar 232. A coiled torsion spring 262 is mounted on one pin 254 of sear assembly 242. Spring 262 has a first leg 262*a* abutting a stop on frame 20, and a second leg portion 262*b* attached to sear assembly 242 to bias the upper end of sear assembly 242 toward a rearward position relative to pistol 10.

Hammer 282 is pivotally mounted to frame 20 by a hammer pin 274. A double-torsion spring 276 is mounted to hammer pin 274. Spacers 278 are disposed between coils 276*a* of spring 276 and pin 274. Double-torsion spring 276 biases hammer 282 in a forward direction. Double-torsion spring 276 includes legs 276*b* that extend downward through frame 20. As indicated above, legs 276*b* of spring 276 engage locking collar 172 to bias locking collar 172 in a forward direction. Hammer 282 includes a thumb tab portion 284, a striking surface 286, and two spurs 292, 294, that define notched areas 292*a*, 294*a*, best seen in FIG. 9. Hammer 282 is mounted to frame 20 to engage operatively to sear 242.

More specifically, roller 252 on sear 242 is disposed to selectively support and release spurs 292, 294 of trigger 282 during the operation of pistol 10. In this respect, roller 252 is dimensioned to be disposed within notched areas 292*a*, 294*a* during certain stages of operation of pistol 10.

Figure 15A:
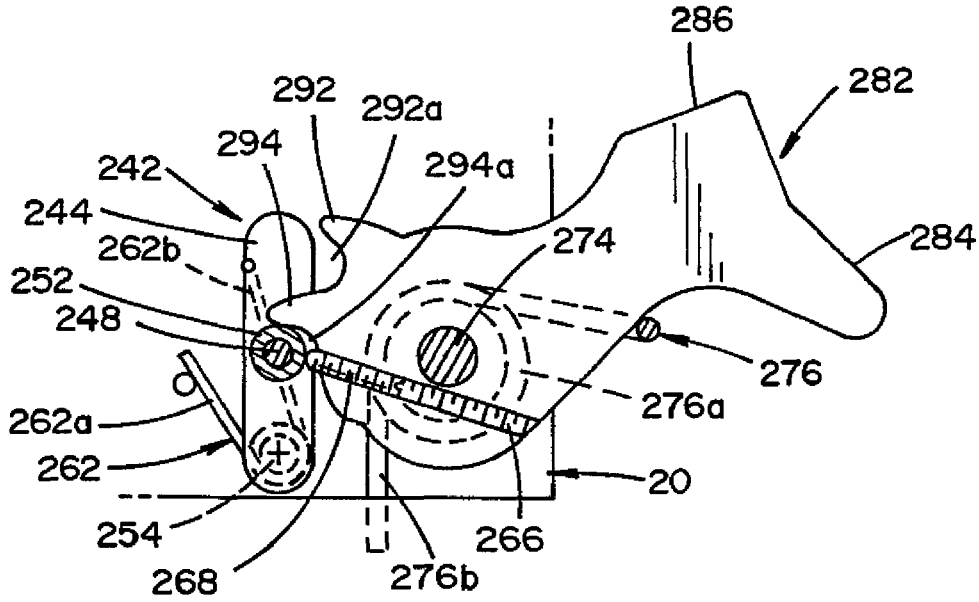
FIG. 15A is an enlarged view of the hammer showing a means for adjusting the sensitivity of the hammer release.

Referring now to FIG. 15A, an embodiment of hammer 282 having a mechanism for adjusting the relative position of roller 252 in notched are 294*a* is illustrated. In the embodiment shown, a threaded bore 266 extends through hammer 282. The axis of threaded bore 266 is aligned to intersect generally with the axis of pin 248 supporting roller 252. A set screw 268 is disposed in threaded bore 266 such that one end of set screw 268 engages roller 252 on sear assembly 242. The position of set screw 268 in threaded bore 266 is adjustable. The position of set screw 268 is adjustable to establish the position of roller 252, relative to notched areas 294*a* of hammer 282. A second set screw (not shown) may be provided behind set screw 268 to lock set screw 268 in position once a desired position for set screw 268 is established. The aforementioned set screw arrangement allows for adjustment of sear assembly 242 relative to hammer 282 to change the distance (travel) trigger 216 must be pulled to discharge pistol 10. Such adjustment also affects, to a small degree, the force required to depress trigger 216.

Figure 15B:
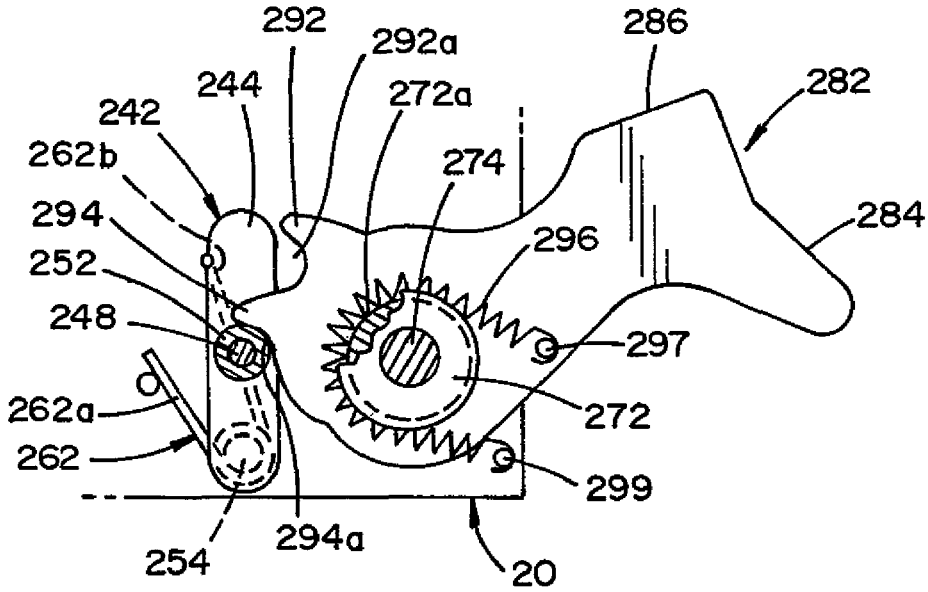
FIG. 15B is an enlarged view of an alternate embodiment of a hammer-biasing arrangement.

Referring now FIG. 15B, an alternate method of biasing hammer 282 is shown. In the embodiment shown in FIG. 15B, a pulley roller 272 is mounted on hammer pin 274 adjacent one side of hammer 282. A rounded groove 272*a* is formed in the edge of roller 272. One end of a tension spring 296 is fastened to hammer 282 by a pin 297. The other end of tension spring 296 is attached by a pin 299 to frame 20. As shown in FIG. 15B, tension spring 296 extends around roller 272 in groove 272*a*. Spring 296 is dimensioned to be expanded and in tension when wrapped around roller 272. The tension in tension spring 296 provides the forward biasing force for hammer 282. In one embodiment of the present invention, a spring-biasing assembly, as shown in FIG. 15B, is provided on each side of hammer 282, thereby providing a dual spring biasing force to hammer 282.

In accordance with another aspect of the present invention, pistol 10 includes a collapsible trigger guard assembly 310, best seen in FIGS. 2 and 8A-8E. Trigger guard assembly 310 is collapsible from an operational (firing) position, as shown in FIG. 8A, to a storage position, as shown in FIG. 8E. In the embodiment shown, trigger guard assembly 310 is comprised of a first guard section 312 and a second guard section 314, best seen in FIG. 2. First guard section 312 is a generally J-shaped element having a first end 312*a*, and a second end 312*b*. In the embodiment shown, first end 312*a* of first guard section 312 is comprised of two, spaced-apart legs that are identical to each other. The legs of first end 312*a* are generally hook-shaped and are disposed within cavity 44 in frame 20. Pins 322 attach the ends of the legs of first end 312*a* to side walls 46, 48 of frame 20 such that first guard section 312 is pivotable relative to frame 20. First guard section 312 defines what would be the front portion of a conventional trigger guard. A biasing element 324, in the form of a torsion spring, biases first guard section 312 toward pins 326 mounted to frame 20. Pins 326 act as stops to define an operational position for first guard section 312.

Second end 312*b* of first guard section 312 is pinned to a first end 314*a* of second guard section 314. Second guard section 314 defines what would be the lower portion of a conventional trigger guard. Second guard section 314 is connected to the lower end of lower trigger section 216 to allow limited relative movement between lower trigger section 216 and second guard section 314. In the embodiment shown, second guard section 314 is fork-shaped and has two spaced-apart leg portions 314*b* that extend toward handgrip 110 when trigger guard assembly 310 is in an operational position. Each leg portion 314*b* includes an elongated slot 332 formed in the inwardly facing surface thereof. Slots 332 are in registry with each other and are dimensioned to receive pins 228 that extend from the sides of lower trigger section 216. In this respect, lower trigger section 216 supports the free end of second guard section 314 when trigger guard 310 and trigger 212 are in an operational position. Slots 332 in leg portions 314*b* of second guard section 314 allow lower trigger section 216 to be depressed during a firing operation, and allow movement of lower trigger section 216 relative to second guard section 314 when the trigger guard assembly 310 is collapsed to the storage position, as shall be described in greater detail below.

A slide 410 is dimensioned to be mounted to the upper portion of frame 20. Slide 410 includes longitudinal-extending slots 412 formed in the inner surface of slide 410 that receive rails 62, 64 on frame 20, as best seen in FIG. 14. Slide 410 is reciprocally movable in the longitudinal direction relative to frame 20. As best seen in FIGS. 1 and 2, a pair of recoil springs 422 is disposed in elongated bores 426 that extend longitudinally through slide 410. A spring 422 is disposed on each side of wall 26. A plug 428 is disposed in the front end of each bore 426 to define abutment surfaces for the front ends of recoil springs 422. The back ends of springs 422 engage frame 20 (not shown). The two recoil springs 422 bias slide 410 to a normal operating position, as seen in FIG. 1. Slide 410 is attached to frame 20 by a slide stop that defines the "normal" or "operating" position of slide 410 relative to frame 20. Slide 410 is movable between the normal position and a blow-back position, as shall be described in greater detail below.

In accordance with another aspect of the present invention, slide 410 includes a movable panel or hatch 450, best seen in FIGS. 1 and 6. Hatch 450 includes a main body section 452 and two parallel leg sections 454 that extend from one end thereof. The ends of leg sections 454 are pinned to slide 410, such that hatch 450 is pivotally mounted to slide 410. Hatch 450 is movable between an open position, shown in FIG. 6, wherein the upper portion of slide 410 is open and the area behind breech end 34 of barrel 24 is accessible, and a closed position, best seen in FIG. 1, wherein hatch 450 is attached to slide 410, thereby closing breech end 34 of barrel 24. When slide 410 is in its normal, rest position relative to frame 20, moving hatch 450 to an open position exposes breech end 34 of barrel 24 and the upper end of handgrip 110 and magazine 120.

A firing pin 462, best seen in FIGS. 10-13A, is mounted to hatch 450. In the embodiment shown, firing pin 462 extends through main body section 452 of hatch 450, such that, when hatch 450 is in a closed position, one end of firing pin 462 is aligned with striking surface 286 of hammer 282 and the other end of firing pin 462 is aligned with breech 34 end of barrel 24, as seen in FIGS. 11A-11E. Firing pin 462 has a cylindrical central body portion 462*a* of firing pin 462. A smaller-diameter, coaxially-aligned pin 462*b* extends from the forward end of body portion 462*a*. In this respect, the forward end of firing pin 462 is stepped and defines a forward-facing, annular surface 462*c*. An outwardly extending flange 462*d* is formed near aft or rear end 462*f* of firing pin 462. A spherical section 462*e* is formed between flange 462*d* and aft end 462*f* of firing pin 462. Firing pin 462 is mounted within a bore 466 of body portion 452 of hatch 450. A return spring 468 surrounds central body portion 462*a* of firing pin 462. Return spring 468 abuts against outwardly extending flange 462*d* on firing pin 462 and against the forward end of bore 466 to bias firing pin 462 in an aft direction.

Figure 10:
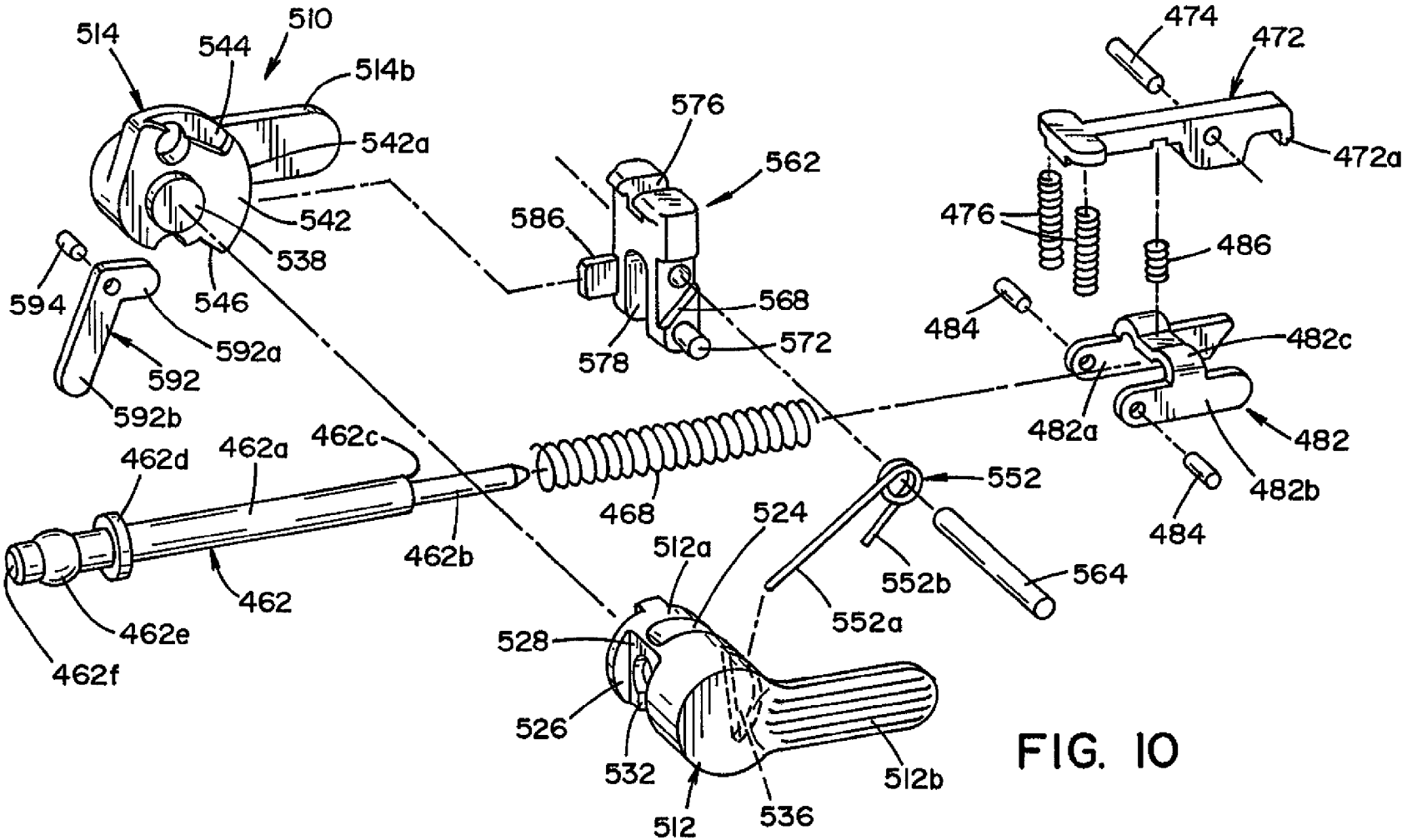
FIG. 10 is an exploded view showing the relationship between a firing pin, safety selector, extractor and rear sight from the pistol of FIG. 1.

An extractor 472, best seen in FIG. 10, is also mounted to hatch 450. Extractor 472 is disposed in a like-shaped opening formed in the upper portion of body section 452 of hatch 450. Extractor 472 is pivotally mounted to body section 452 by a pivot pin 474, such that extractor 472 is pivotable in body section 452 about pin 474. In the embodiment shown, extractor 472 is generally T-shaped and has a first end with a downwardly extending finger or tab 472*a*. Finger 472*a* is dimensioned to capture an annular groove of the casing on cartridge "C," as best seen in FIGS. 11A-11D. Vertically oriented, coil springs 476, disposed within cavities in body section 452 of hatch 450 engage the other end of extractor 472 to bias tab or finger 472*a* in a downward direction. Biasing springs 476 are disposed on opposite sides of firing pin 462 and bias extractor 472, such that tab or finger 472*a* on extractor 472 is biased into the annular groove of the casing on cartridge "C," as best seen in FIGS. 11A-11D.

A firing pin lock 482 is mounted to body section 452 of hatch 450. Lock 482 prevents movement of firing pin 462 unless lower trigger section 216 has been depressed for a pre-determined amount during a step in firing pistol 10. Firing pin lock 482 is a generally H-shaped element that includes spaced-apart leg sections 482*a*, 482*b* that are connected by a transverse section 482*c*. The free ends of leg sections 482*a*, 482*b* are pinned by pins 484 to body section 452 of hatch 450. Leg sections 482*a*, 482*b* extend generally parallel to the longitudinal axes of frame 20 and slide 410. Transverse section 482*c* extends over the top of firing pin 462. A biasing spring 486 is disposed between extractor 472 and transverse section 482*c* of lock 482 to bias lock 482 downward onto the upper surface of firing pin 462. Transverse section 482*c* is disposed relative to firing pin 462, such that transverse section 482*c* is disposed against, i.e., in front of, the stepped portion of firing pin 462. In other words, when biased against firing pin 462, transverse section 482*c* of lock 482 is disposed to prevent forward movement of firing pin 462 by abutting against annular surface 462*c* defined by the stepped portion of firing pin 462.

Actuator 226 (described above) is dimensioned and positioned within frame 20 to engage leg section 482*a* of firing pin lock 482 when lower trigger section 216 is pulled a predetermined distance. Actuator 226 causes leg section 482*a* of lock 482 to rotate about pins 484, thereby moving transverse section 482*c* of lock 482 up and away from firing pin 462 to a position where transverse section 482*c* no longer obstructs forward movement of firing pin 462. Actuator 226 and lock 482 are dimensioned such that squeezing lower trigger section 216 causes lock 482 to move to the non-obstructing position immediately before sear 242 moves to a position releasing spur 294 of hammer 282 to contact firing pin 462.

In accordance with another aspect of the present invention, a safety selector 510, shown in exploded view in FIG. 10, is attached to hatch 450. Safety selector 510 is rotatable about an axis that is transverse to the longitudinal axis of slide 410. Safety selector 510 is mounted at the aft portion of hatch 450.

In the embodiment shown, safety selector 510 is comprised of a first selector section 512 and a second selector section 514 that are dimensioned to be joined along an axis of rotation. Safety selector 510 is dimensioned to be received and mounted in a generally cylindrical bore that is partially defined by hatch 450 and partially defined by slide 410. First selector section 512 has a cylindrical body portion 512*a* dimensioned to be received in the cylindrical bore in hatch 450 and frame 20. A lever 512*b* is formed at one end of the cylindrical body portion 512*a*. Cylindrical body portion 512*a* is formed to have an inner cylindrical cavity 522, best seen in FIGS. 11A-11E. A slot 524 that communicates with cavity 522 is formed in the front side of cylindrical body portion 512*a*. Cavity 522 and slot 524 are dimensioned to receive the aft-end of firing pin 462, as best seen in FIGS. 11A-11E. In this respect, body portion 462*a* of firing pin 462 extends through slot 524, while spherical portion 462*e* is disposed within cylindrical cavity 522. A recess 526, best seen in FIG. 10, is formed in the back side of cylindrical portion 512*a*. As best seen in FIGS. 11A-11E, recess 526 defines a flat surface 528. As also seen in FIGS. 11A-11E, end 462*f* of firing pin 462 extends beyond flat surface 528, but is disposed within the outer cylindrical body portion 512*a*. A second slot 532 is formed in the lower portion of cylindrical portion 512*a* to communicate with cavity 522. Slots 524 and 532 allow cylindrical body portion 512*a* to rotate relative to firing pin 462, as shall be described in greater detail below.

Referring now to second selector section 514, a lever 514*b*, which is a mirror image of lever 512*b*, is formed at one side of second selector section 514. A cylindrical plug 538 is formed at the inward side of second selector section 514. Plug 538 is dimensioned to be received in cylindrical cavity 522 in first selector section 512 to align and attach selector sections 512, 514 together. When selector section 512, 514 are joined together, levers 512*b*, 514*b* are in parallel alignment. Selector section 514 includes a cam portion 542 having a cylindrical cam surface 542*a*. A recess or notch 544 is formed in cam portion 542, as best seen in FIG. 10. Cam portion 542 defines a shoulder or edge 546 at one end thereof.

A slot 536, best seen in phantom in FIG. 10, is formed in cylindrical body portion 512*a* to receive a leg 552*a* of a torsion spring 552 to bias safety selector 510 to a predetermined position. As shall be described in greater detail below, safety selector 510 is movable between a firing position, a safe position and a de-cocking position.

Figure 16A:
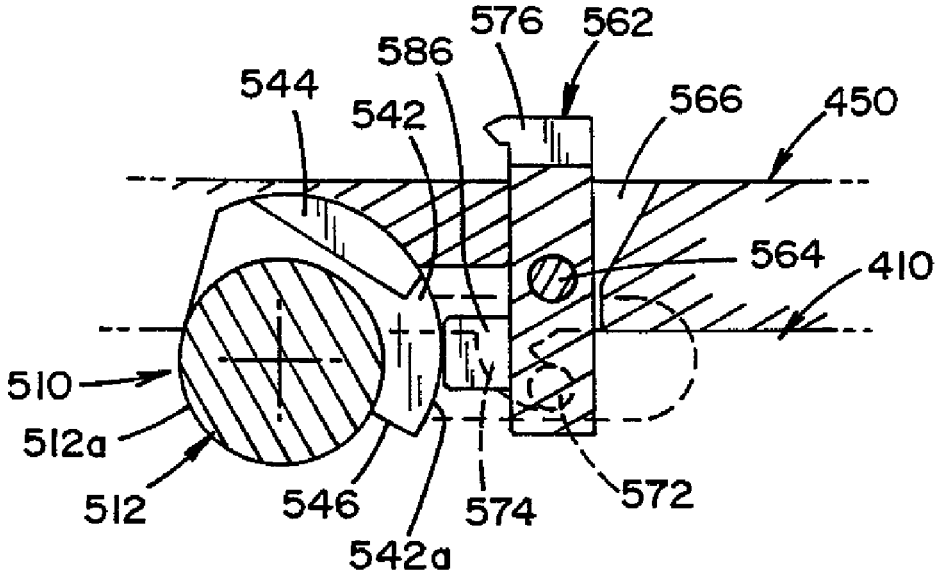
FIGS. 16A and 16B illustrate how the rear sight interacts with the safety selector to secure and release a movable hatch on the slide.
Figure 16B:
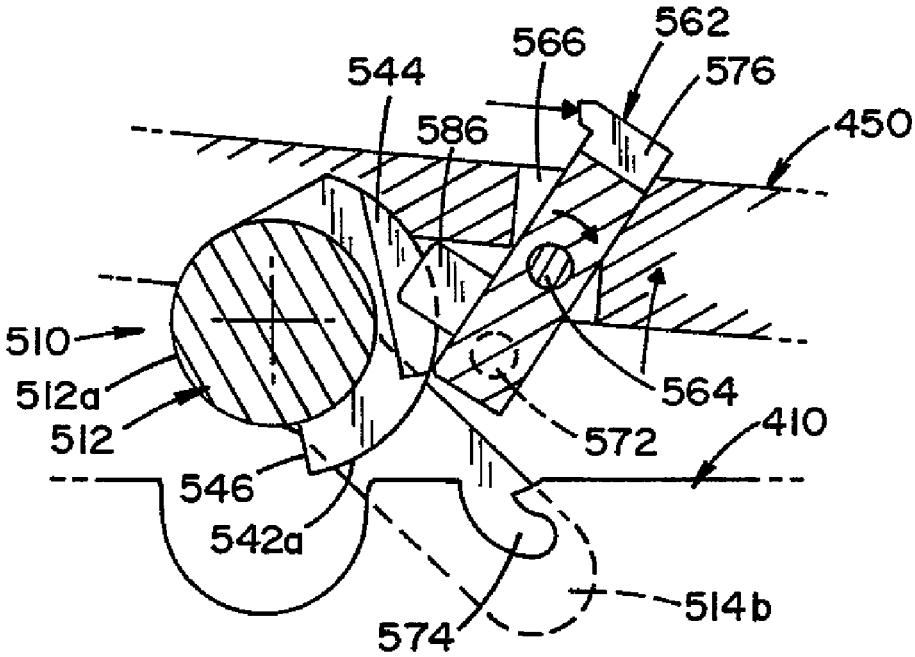

A latch element 562 is provided to secure hatch 450 in a closed position to slide 410. In the embodiment shown, latch element 562 is comprised of a rear sight that is used for sighting pistol 10. Latch element 562 is generally rectangular in shape and is mounted to hatch 450 by a pivot pin 564 extending through a mid-section of latch element 562. Latch element 562 is disposed in an opening 566, as best seen in FIGS. 1, 16A and 16B, such that the upper end of latch element 562 projects above the surface of hatch 450. The upper and lower portions of latch element (plate) 562 are pivotable about pivot pin 564, as illustrated in FIGS. 16A and 16B. Opening 566 is formed to limit rotation of latch element 562 between a vertical position (FIG. 16A) to a forward position (FIG. 16B). Torsion spring 552 (described above with respect to safety selector 510) is mounted to pivot pin 564. A leg 552*b* of torsion spring 562 is received in an angled slot 568 in latch element 562 to bias latch element (rear sight) 562 to the vertical position. The lower portion of latch element (rear sight) 562 includes locking elements for locking latch element 562, and in turn, hatch 450 to slide 410. In the embodiment shown, the locking elements are pins 572 that extend outwardly from the sides of latch element 562. Pins 572 are dimensioned to be received in slots 574, best seen in FIG. 16B, that are formed in slide 410. When latch element 562 is in the vertical position (FIG. 16A), hatch 450 is secured to slide 410 by pins 572 being disposed in slots 574. Forcing the upper portion of latch element 562 forward (as shown in FIG. 16B), against the biasing force of leg portion 552*b* of spring 552 (see FIG. 10), causes pins 572 to move out of slots 574 in slide 410, thereby releasing hatch 450 from slide 410 and allowing hatch 450 to move to the open position.

A slot 576 is formed in the upper edge of latch element 562 to be used in conjunction with a front sight 582, best seen in FIG. 1, as a means for aiming pistol 10. A slot 578, best seen in FIG. 10, is also formed in the lower portion of latch element 562 to allow firing pin 462 to extend therethrough.

A tab 586, best seen in FIGS. 10, 16A and 16B, extends rearward from the back surface of latch element 562. Tab 586 is designed to engage cam portion 542 on safety selector 510 when latch element 562 is in a vertical, locking position and safety selector 510 is in a firing position, as illustrated in FIG. 16A. When the aforementioned components are in these positions, cam portion 542 on safety selector 510 engages tab 586 on latch element 562 thereby preventing pivotal movement of latch element 562. In other words, hatch 450 is secured to slide 410 and latch element 562 is locked in place when hatch 450 is in the closed position and safety selector 510 is in a firing position. When safety selector 510 is moved to a "safe position," recess 544 in cam portion 542 is aligned with tab 586, thereby allowing latch element 562 to pivot about pivot pin 564 and to remove pins 572 from slot 574, which allows hatch 450 to be released from slide 410.

Figure 13A:
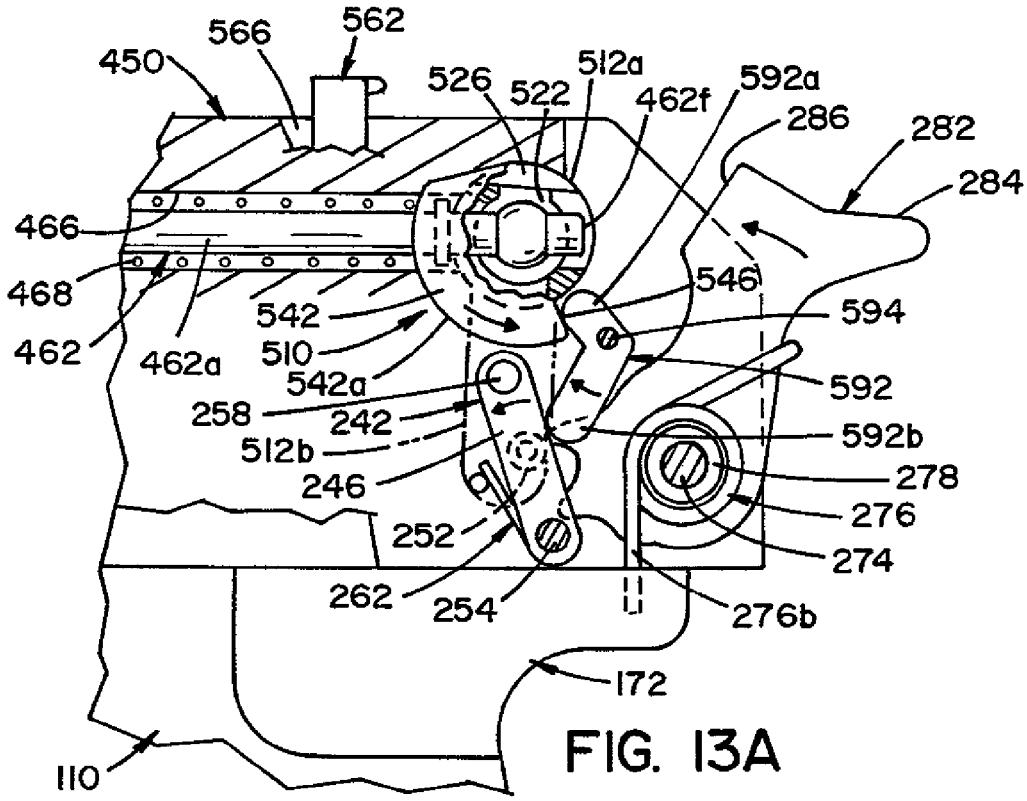
FIGS. 13A and 13B illustrate how the hammer is moved from a "half-cocked" position to a "de-cocked" position.

Referring now to FIG. 13A, a de-cocking lever 592 is pivotally mounted to hatch 450 by a pivot pin 594. In the embodiment shown, de-cocking lever 592 is generally L-shaped and has a first leg portion 592*a* and a second leg portion 592*b*. First leg portion 592*a* of de-cocking lever 592 is positioned to engage shoulder 546 on cam portion 542 of safety selector 510 when safety selector 510 is moved to a de-cocking position, best seen in FIG. 13A. Second leg portion 592*b* of de-cocking lever 592 is disposed to engage sear assembly 242. In this respect, de-cocking lever 592 is positioned relative to cam portion 542 of safety selector 510 and sear assembly 242, such that movement of safety selector 510 to a de-cocking position causes shoulder 546 of cam portion 542 of safety selector 510 to engage first leg portion 592*a*, as shown in FIG. 13A, which causes de-cocking lever 592 to pivot about pivot pin 594. Pivoting of de-cocking lever 592 causes second leg portion 592*b* to engage frame member 246 of sear 242 such that sear 242 releases hammer 282 from a cocked position or a half-cocked position to a de-cocked position, as shown in FIG. 13B.

Figure 13B:
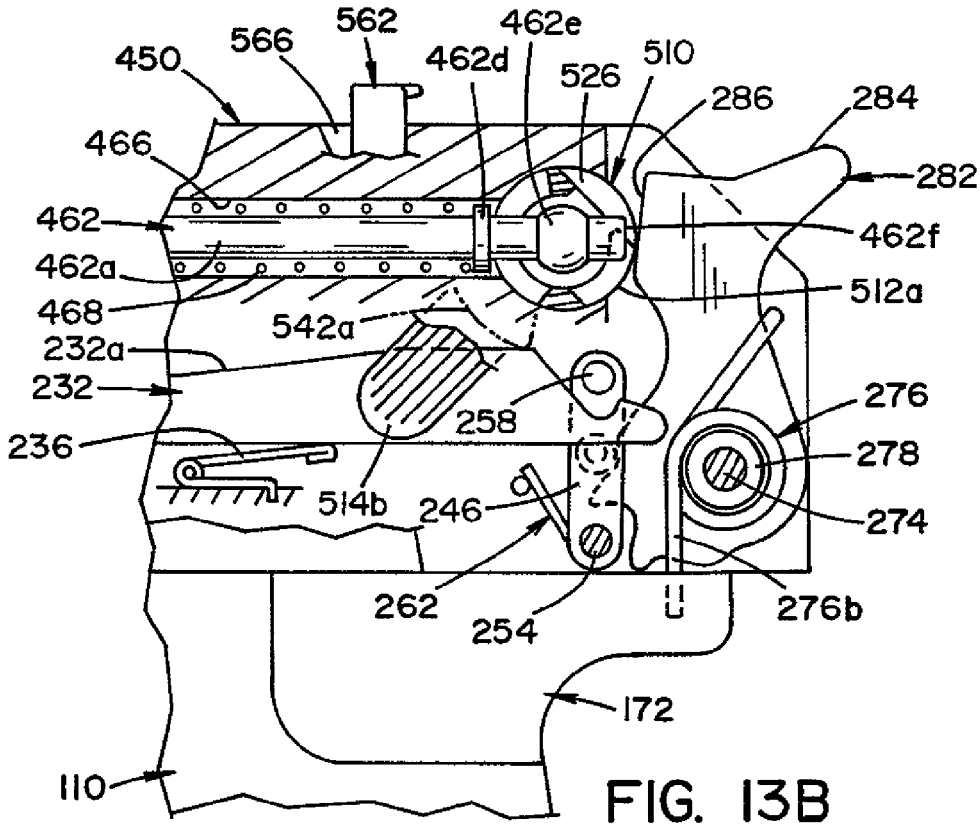

As illustrated in FIGS. 13A and 13B, as lever 512*b*, 514*b* of safety selector 510 are rotated to a de-cocking position (FIG. 13A), cylindrical body portion 512*a* rotates relative to end 462*f* of firing pin 462. Rotation of body portion 512*a* moves recess 526 out of alignment with hammer 282 such that when sear 242 releases hammer 282, striking surface 286 of hammer 282 engages the outer surface of cylindrical portion 512*a*, rather than end 462*f* of firing pin 462, thereby preventing firing of pistol 10.

Figure 11C:
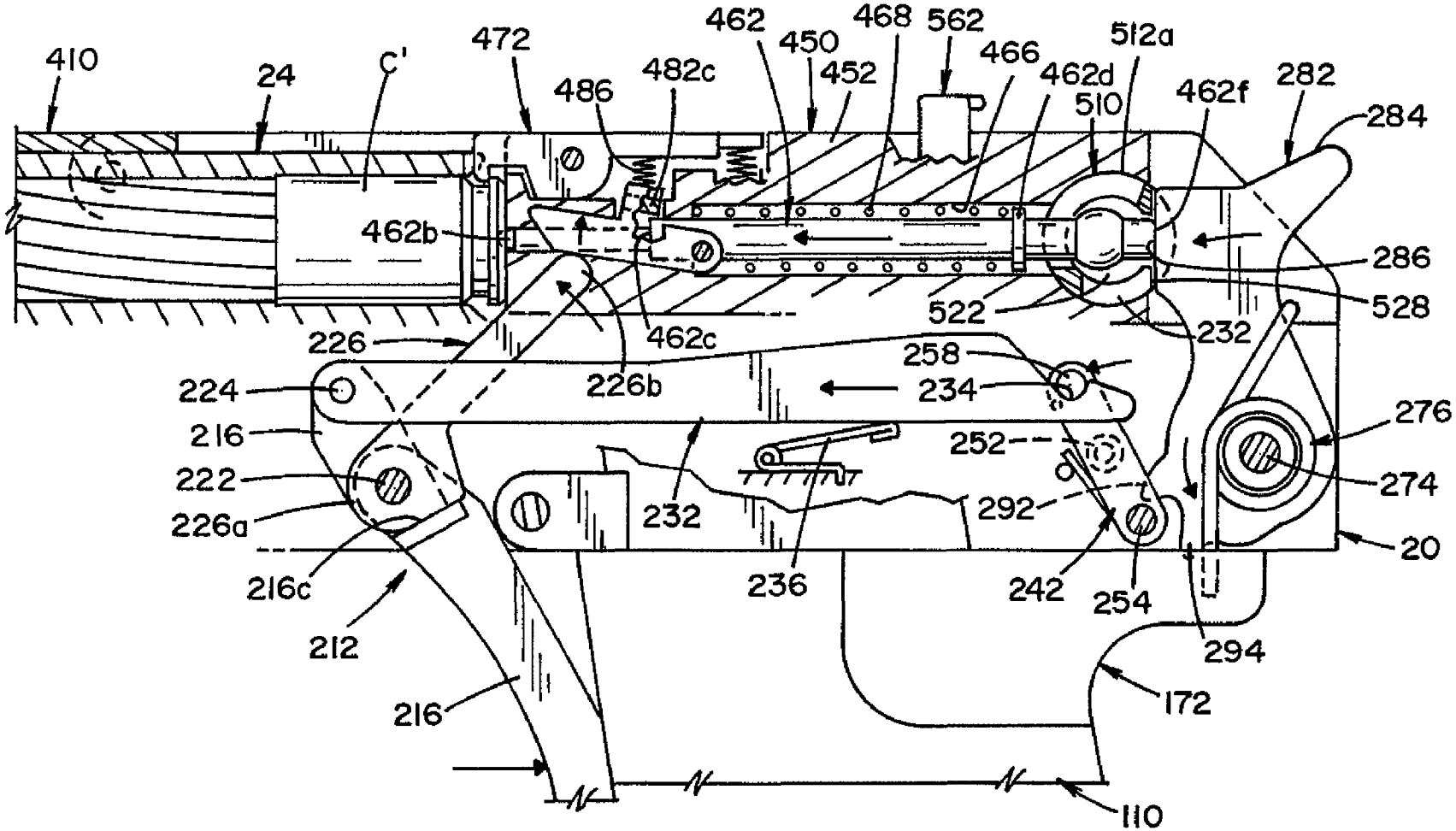
FIG. 11C is a side view of the firing mechanism shown in FIG. 11A showing the relative movement of parts of the firing mechanism when the pistol is fired.
Figure 12:
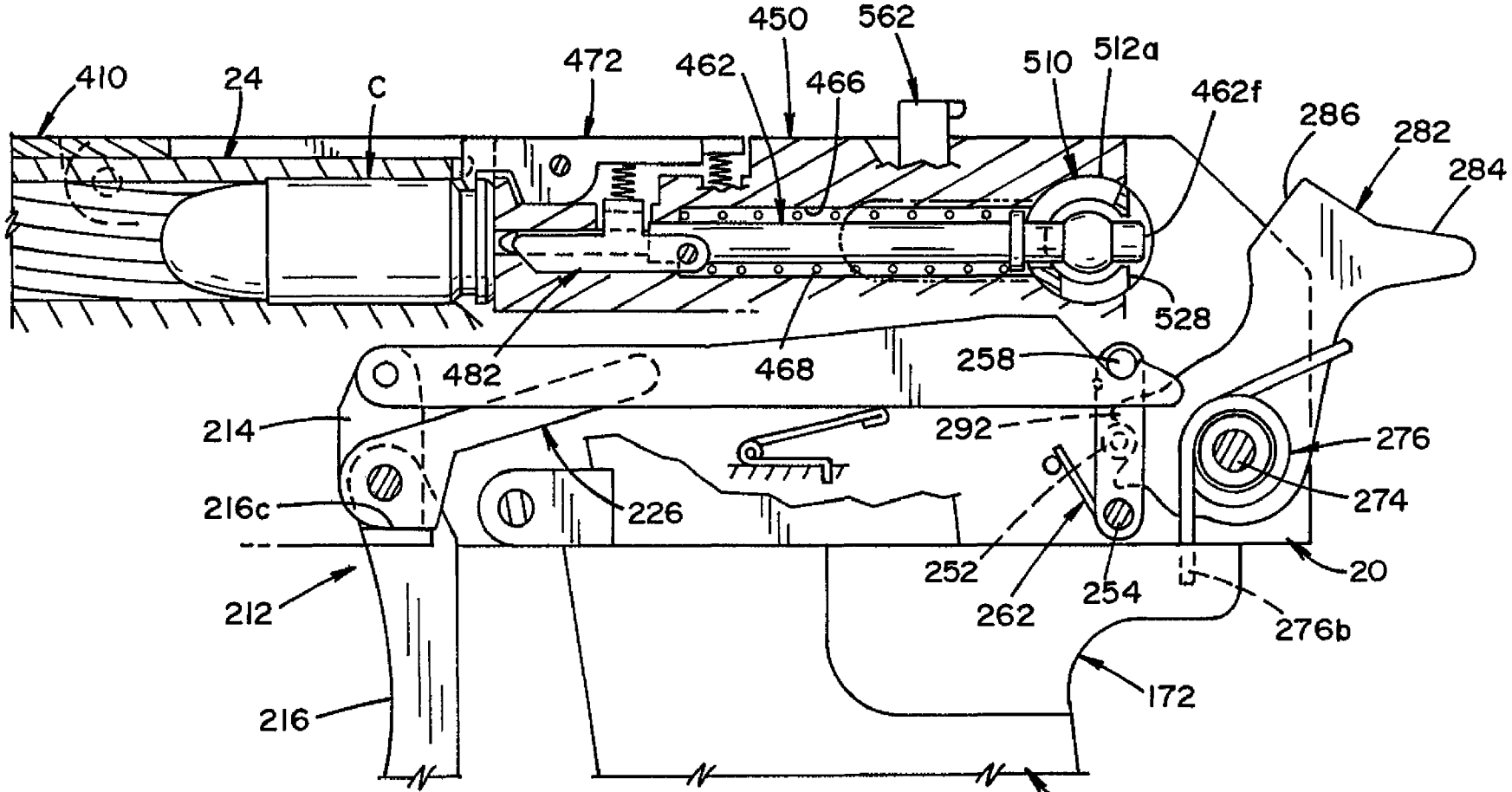
FIG. 12 is an enlarged, partially-sectioned, side view of the pistol of FIG. 1 showing the relative position of parts of the firing mechanism when the hammer is in a "half-cocked" position.

As indicated above, safety selector 510 is movable between one of three positions. Safety selector 510 has a first, firing position, best seen in FIG. 1, wherein levers 512*b*, 514*b* on safety selector 510 are generally aligned, i.e., oriented in a direction, with barrel 24 of pistol 10. When in the firing position, recess 526 in cylindrical body portion 512*a* of selector 510 is oriented in a position such that hammer 528 may engage, i.e., strike, aft end 462*f* of firing pin 462, as illustrated in FIG. 11C.

Safety selector 510 is movable to a second, safe position wherein levers 512*b*, 514*b* of safety selector 510 are oriented downwardly relative to the firing position. With safety selector 510 in this position, the arcuate wall section of cylindrical body portion 512*a* is disposed between aft end 462*f* of firing pin 462 and hammer 528, thereby preventing striking surface 286 of hammer 282 from contacting firing pin 462, as illustrated in FIG. 13B. This, in turn, prevents firing of pistol 10. In addition, when safety selector 510 is moved from the firing position to the safe position, cam portion 542 is brought into engagement with upper surface 232*a* of trigger bar 232 and forces trigger bar 232 downward out of engagement with sear assembly 242, as shown in FIG. 13B.

Safety selector 510 is further movable to a third, hammer-de-cocking position when levers 512*b*, 514*b* of safety selector 510 are moved further downward past the second safety position, as best seen in FIG. 13A. As safety selector 510 is moved past the safety position, shoulder 546 on cam portion 542 of safety selector 510 engages leg 592*b* of L-shaped de-cocking lever 592 causing de-cocking lever 592 to pivot about pin 594. As de-cocking lever 592 pivots, second leg 592*a* of de-cocking lever 592 engages sear assembly 242, moving sear assembly 242 from a hammer-support position to a release position. As a result, hammer 282 is released from a cocked position, as shown in FIG. 13A, to an un-cocked position, as shown in FIG. 13B. The outer surface of cylindrical body portion 512*a* remains as a barrier between hammer 282 and firing pin 462 as safety selector 510 moves from the safety position to the de-cocked position, thereby preventing firing of pistol 10 as hammer 528 is released to the un-cocked position.

In the embodiment shown, the de-cocking position of safety selector 510 is a temporary or momentary position of safety selector 510. In this respect, safety selector 510 will remain in the firing position or safe position once moved to either position. Safety selector 510 is spring-biased to return to the safety position when safety selector 510 is released after being moved past the safety position to the de-cocking position. Thus, when safety selector 510 is moved past the safe position, the interaction of cylindrical portion 512*a* of safety selector 510 and de-cocking lever 592 and sear assembly 242 will release hammer 282 from a cocked position to an un-cocked position, and release of safety selector levers 512*b*, 514*b* will allow safety selector 510 to return to the safe position.

A rocker button 598, best seen in FIG. 2, is mounted on one side of slide 410 to lock slide 410 to frame 20 when slide 410 is in its normal position relative to frame 20. When rocker button 598 is depressed as shown in FIG. 2, the forward end of rocker button 598 engages a rearward facing surface 599*a* of a slide step 599. Engagement of locking button 598 with surface 599*a* of slide stop 599 prevents movement of slide 410 relative to frame 20, when hatch 450 is moved to an opened position.

The present invention shall now be further described with respect to the operation of pistol 10. In accordance with one aspect of the present invention, pistol 10 is collapsible from a use (operational) position, best seen in FIGS. 1-3, to a storage position, best seen in FIG. 4. In the storage position, handgrip 110 is adjacent to frame 20, such that pistol 10 assumes a generally rectangular configuration. As further shown in FIG. 4, in this position, pins 162 on handgrip 110 that connect handgrip 110 of frame 20 are positioned at the rear ends of slots 52 in frame 20.

In the storage position, pin 58 on the underside of the front end of frame 20 is disposed within slot 142 that extends along leading edge 116 of handgrip 110. Still further, as best seen in FIG. 8E, the pinned connections between first and second trigger guard sections 312, 314 and between lower trigger 216 and second trigger guard section 314 allows trigger guard 310 to collapse and be stored in cavity 44 in the underside of frame 20.

As illustrated in FIG. 4, the ability of proximal end 112 of handgrip 110 to slide along the length of frame 20 (the result of pins 162 on handgrip 110 being movable in slots 52 in frame 20) enables handgrip 110 to be positioned for storage in a more compact configuration as contrasted to a configuration that a pistol would assume if the grip were limited to rotation about a fixed axis.

As also illustrated in the drawing, the ability of trigger assembly 212 and trigger guard assembly 310 to collapse into cavity 44 in frame 20 enables handgrip 110 to be positioned against frame 20. Together, these features of pistol 10 allow pistol 10 to be stored in a compact shape, i.e., configuration.

Figure 7:
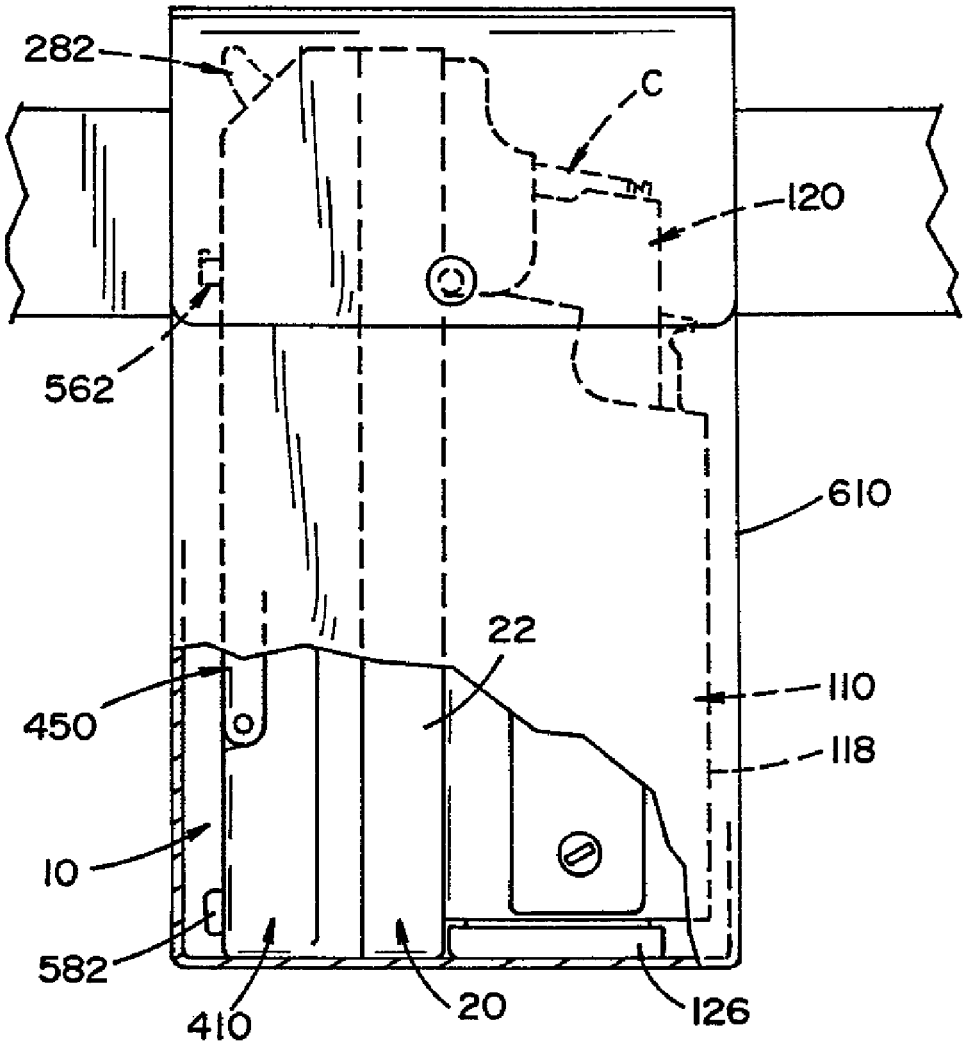
FIG. 7 is a partially-sectioned view showing the pistol of FIG. 1 in a storage position contained within a belt-mounted case.

FIG. 7 shows pistol 10 in a storage position contained within a belt-mounted case 610. FIG. 7 illustrates how pistol 10 may be stored and carried in an unobtrusive and concealed fashion. In accordance with one embodiment of the present invention, a .380 caliber pistol capable of carrying eight (8) .380 caliber cartridges "C" within magazine 120 in handgrip 110 can assume a storage configuration that fits within a generally rectangular case, wherein the internal dimensions of the case are about 4.5 inches high, about 2.65 inches wide, and about 1.0 inch deep.

The operation of pistol 10 shall now be described. Pistol 10 is transformed from a storage configuration to an operational configuration by removing pistol 10 from any storage case or container and by releasing handgrip 110 from frame 20 by sliding handgrip 110 forward relative to frame 20. With distal end 114 of handgrip 110 released from frame 20, handgrip 110 is free to pivot about the axis of pin 162 that connects handgrip 110 to frame 20. Sliding handgrip 110 forward until pin 162 abuts the forward end of slots 52 enables handgrip 110 to be pivoted to a position where the upper end of handgrip 110 engages the underside of frame 20, with the upper end of magazine 120 extending through opening 42 in frame 20. During pivoting of handgrip 110 toward the operating position, locking collar 172 is pushed back by the upper end of handgrip 110 toward the aft end of frame 20. Once handgrip 110 has moved to the operational position, locking collar 172 is returned by biasing spring legs 276*b* of torsion spring 276 to its forward position, wherein notch 182 on handgrip 110 captures tab 178 on locking collar 172, thereby locking handgrip 110 in the operational position relative to frame 20.

If a cartridge "C" is not already chambered within barrel 24, a cartridge "C" may be chambered in one of two ways. Forcing slide 410 rearward against the biasing force of recoil springs 422 forms a cavity behind breech end 34 of barrel 24, as slide 410 is moved back over frame 20. The cavity formed by movement of slide 410 rearward relative to frame 20 allows a cartridge "C" from magazine 120 to be forced up toward breech end 34 of barrel 24. At the same time, the lower end of slide 410 forces hammer 282 back to a "fully cocked" position, as roller 252 on sear assembly 242 engages the underside of spur 294 of hammer 282. Return of slide 410 forces the uppermost cartridge "C" in magazine 120 into breech end 34 of barrel 24 and returns slide 410 to its normal, rest position, wherein firing pin 462 within hatch 450 is aligned with the back end of cartridge "C" in barrel 24.

Another way for inserting a cartridge "C" into barrel 24 is to release hatch 450 from slide 410 and move hatch 450 to an open position, thereby exposing breech end 34 of barrel 24. Hatch 450 is opened by forcing the upper end of latch element (rear sight) 562 forward until pins 572 on the lower end of latch element 562 clear slots 574 in slide 410 which releases hatch 450. As indicated above, if safety selector 510 is in a firing position, the engagement of tab 586 on latch element 562 with cam portion 542 on safety selector 510 will prevent movement of latch element 562.

With hatch 450 in an open position, a cartridge "C" can be manually inserted into breech end 34 of barrel 24. With cartridge "C" inserted in barrel 24, hatch 450 is returned to its original closed position. Because latch element (rear sight) 562 is biased toward a vertical position, when hatch 450 is returned to the closed position, hatch 450 will be secured in the closed position by the biased movement of latch element 562. When cartridge "C" is inserted into barrel 24 using hatch 450 to bring pistol 10 to a firing condition, hammer 282 can be cocked backward by the user's thumb to bring hammer 282 to a "fully cocked" position, as shown in FIG. 11A. Either method of chambering a round into barrel 24 of pistol 10 brings pistol 10 to a condition ready for firing. To fire pistol 10, safety selector 510 must be moved to the firing position, best seen in FIG. 1. In this position, recess 526 in cylinder body portion 512*a* allows hammer 282 to engage aft end 462*f* of firing pin 462.

The positions of trigger bar 232, sear assembly 242 and hammer 282, when firing assembly 210 is in a normal position, are best seen in FIG. 11A. When trigger section 216 is in a normal position, as shown in FIG. 11A, hammer 282 is in a fully cocked position. Roller 252 of sear assembly 242 maintains hammer 282 in this position by its position below spur 294 on hammer 282. Pin 258 of sear assembly 242 is disposed in notch 234 in trigger bar 232. Sear assembly 242 maintains the position shown based on trigger bar 232 which is maintained in its position by trigger bar biasing spring 236. Depression of lower trigger 216 by the user causes several actions to occur. One action is movement of firing pin lock 482. As lower trigger section 216 is depressed, free end of actuator 226 moves upward as actuator 226 moves with lower trigger section 216. As lower trigger section 216 continues to be depressed, the free end of actuator 226 is brought into engagement with leg section 482*a* of firing pin lock 482. Further depression of lower trigger section 216 causes the free end of actuator 226 to force lock 482 to pivot about lock pins 484, thereby raising transverse section 482*c* off of firing pin 462 to a position wherein it does not obstruct movement of firing pin 462 in a forward direction.

At the same time, depression of lower trigger section 216 causes trigger bar 232 to move in a forward direction. Because notch 234 in the aft end of trigger bar 232 is biased upward into engagement with pin 258 on sear assembly 242, as trigger bar 232 moves forward, trigger bar 232 pulls sear assembly 242 with it. FIG. 11B illustrates the movement of actuator 226, trigger bar 232, sear assembly 242 and firing pin lock 482 as lower trigger section 216 is depressed.

A point is reached where roller 252 no longer supports spur 294 on hammer 282. At the point where roller 252 no longer supports spur 294, hammer 282 is free to rotate forward under the forward-biasing effect of the double-coiled torsion spring 276. The forward rotation of hammer 282 causes striking surface 286 of hammer 282 to contact aft end 462*f* of firing pin 462, forcing firing pin 462 forward until pin 462*b* of firing pin 462 engages cartridge "C" within barrel 24, thereby firing the same to eject the bullet from pistol 10. FIG. 11C illustrates the relative position of lower trigger section 216, actuator 226, trigger bar 232, sear assembly 242 and hammer 282 immediately after the firing of pistol 10.

Figure 11D:
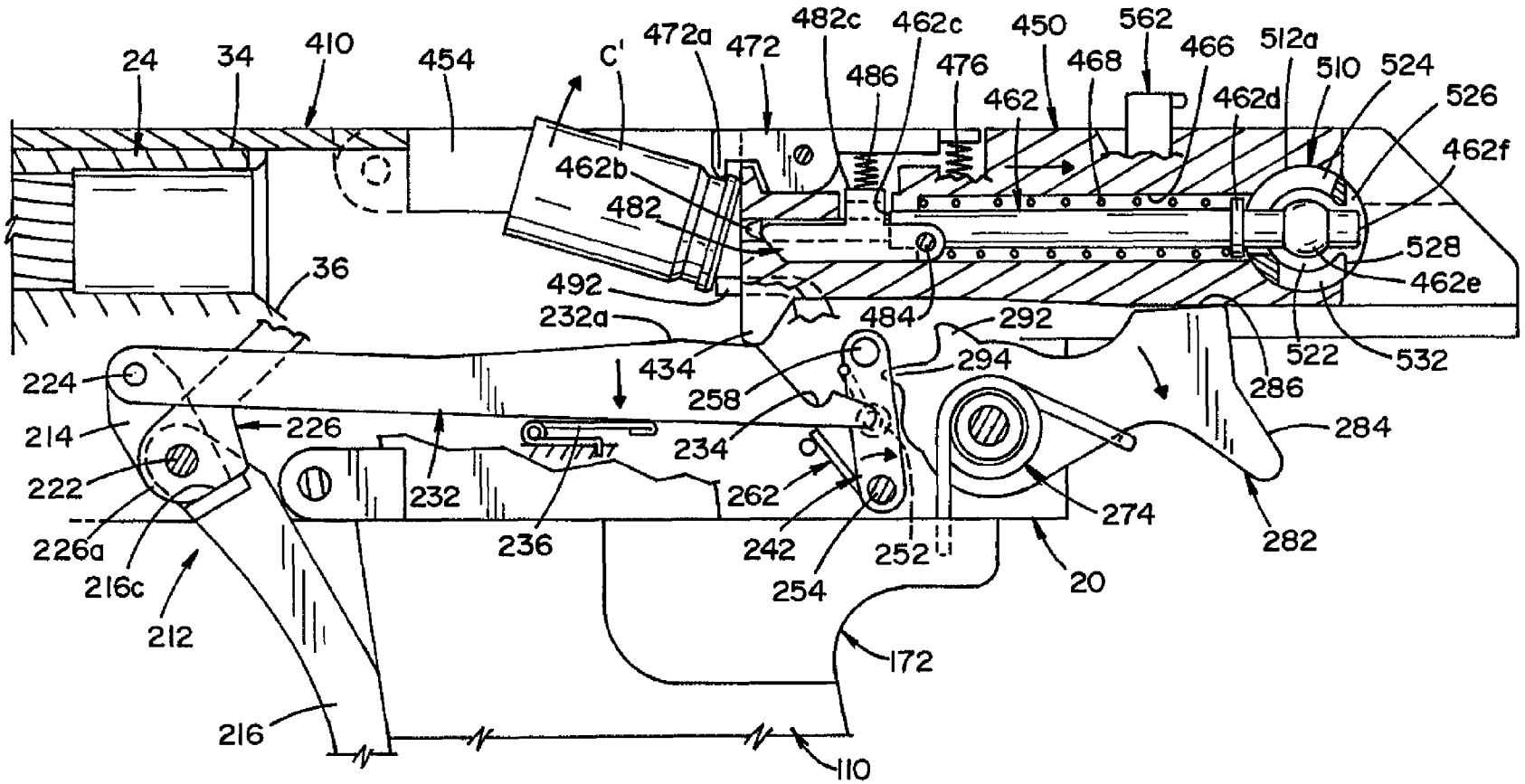
FIG. 11D is a view of the firing mechanism shown in FIG. 11A showing the firing mechanism immediately after the pistol has been fired, showing the slide in a "blow-back" position and a casing being ejected from the pistol.

As a result of discharging the bullet, slide 410 is blown back along frame 20. As slide 410 is blown back following the firing of a shell, tab 472*a* on extractor 472 withdraws a spent casing from barrel 24. As best seen in FIG. 11D, as slide 410 pulls the casing back, the lower end of the casing engages an ejector 492 on frame 20 that ejects the spent casing "C" through an opening in the upper portion of slide 410 that is defined between leg section 454 of hatch 450.

During the rearward motion of slide 410, a projection 434 on the underside of slide 410 moves along ramped surface 232*a* of trigger bar 232, thereby forcing trigger bar 232 downward out of engagement with pin 258 on sear assembly 242. Sear assembly 242 is then free to rotate, under the biasing effect of sear spring 262, in a rearward direction. At the same time that trigger bar 232 is releasing sear assembly 242, slide 410 forces hammer 282 to a cocked position. FIG. 11D illustrates the movement of trigger bar 232, sear assembly 242 and hammer 282 as slide 410 is blown backward as a result of firing pistol 10.

Figure 11E:
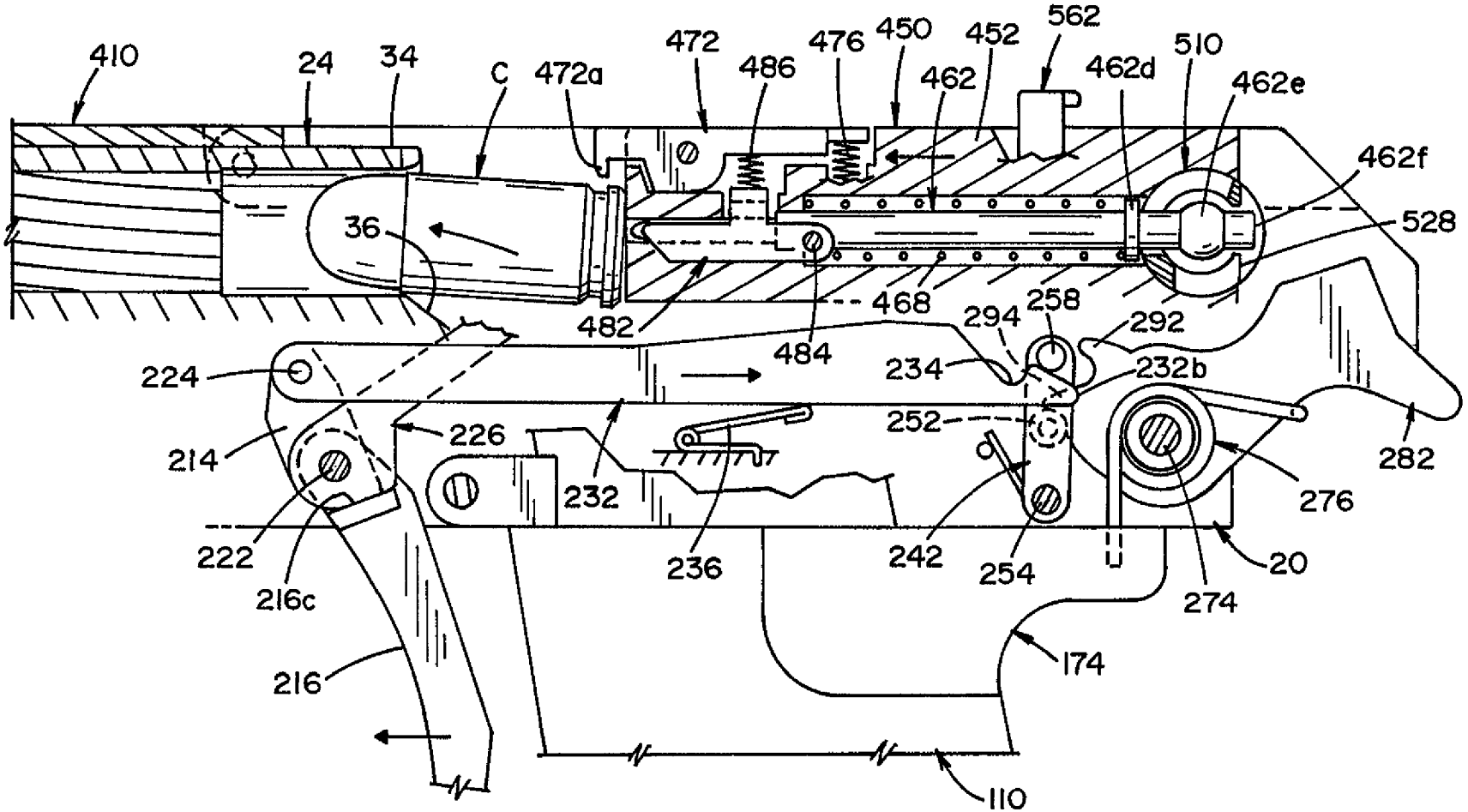
FIG. 11E is a view showing the relative movement of parts of the firing mechanism as the slide returns to a firing position and feeds a new cartridge into the barrel of the pistol.

Recoil springs 422 disposed between slide 410 and frame 20 retard the blow-back movement of slide 410. Compressed recoil springs 422 exert a forward bias on slide 410 to return slide 410 to its original, i.e., rest, position. During the return of slide 410, a new cartridge "C" forced upward from magazine 120, is inserted into barrel 24. Trigger bar biasing spring 238 attached to trigger bar 232 returns trigger bar 232 and lower trigger section 216 to their original positions. Rounded back end 232*b* of trigger bar 232 slides under roller 252 of sear assembly 242 to allow pin 258 to reset itself in notch 234 of trigger bar 232. FIG. 11E illustrates movement of lower trigger section 216 and trigger bar 232 as slide 410 returns to its normal position. Pistol 10 then has a new cartridge "C" in barrel 24 and hammer 282 is in a cocked position, ready for subsequent firing of pistol 10.

After use of pistol 10 has been completed, to collapse pistol 10 from an operating position to a storage position, safety selector 510 is moved to a de-cocking position allowing hammer 282 to move to a de-cocked position wherein striking face 286 of hammer 282 rests against circular body portion 512*a* of safety selector 510. In addition to de-cocking hammer 282, movement of safety selector 510 to the de-cocking position causes cam portion 242 of safety selector 510 to engage upper surface 232*a* of trigger bar 232, thereby disengaging trigger bar 232 from sear assembly 242. As indicated above, the de-cocking position is a temporary position and release of levers 512*b*, 514*b* allows safety selector 510 to move to a safe position, as shown in FIG. 8A. Trigger bar 232 remains disengaged from sear assembly 242 when safety selector 510 is in the safe position, as illustrated in FIG. 13B.

With safety selector 510 in a safe position, collar 172 is pulled backward against the biasing force of legs 276*b* of tension spring 276. Handgrip 110 is then free to pivot about pin 162. As shown in FIG. 8A, pivoting of handgrip 110 about pin 162 causes leading edge 116 of handgrip 110 to engage lower trigger section 216 and the end of second guard section 314 of trigger guard assembly 310, thereby causing lower trigger section 216 to move in a forward direction and causing trigger guard assembly 310 to collapse, as best seen in FIGS. 8B and 8C. In this respect, lower trigger section 216 is free to pivot about pin 222 in a forward direction without disturbing upper trigger section 214 or actuator 226. As handgrip 110 continues to pivot about pin 162, leading edge 116 of handgrip 110 contacts the underside of frame 20. As illustrated in FIGS. 8C and 8D, pin 58 on the underside of frame 20 is received in opening 144 of handgrip 110. When leading edge 116 of handgrip 110 abuts the underside of frame 20, walls 162*a* on the ends of pin 162 align with slots 52 in frame 20, and allow handgrip 110 to be slid rearward relative to frame 20 to a storage position, as shown in FIG. 8E. As handgrip 110 slides along the underside of frame 20, pin 58 slides within slot 142 along leading edge 116 of handgrip 110. In a collapsed storage position, pistol 10 may be stored in a case 610, as illustrated in FIG. 7, or in any other unobtrusive location on a user, such as a pocket or purse.

The present invention thus provides a pistol 10 that can be stored and worn in a compact, unobtrusive configuration. Pistol 10 may be stored in a rectangular container or case, or on the person of a user, without conveying the image of a conventional hand-held firearm. In addition, hatch 450 on slide 410 provides an easy way for loading a first round into pistol 10 without the need to "rack" the slide. Still further, hatch 450 provides access to the breech area of the firearm and enables correction or maintenance in the event of jamming of the bullet in the barrel.

Figure 17:
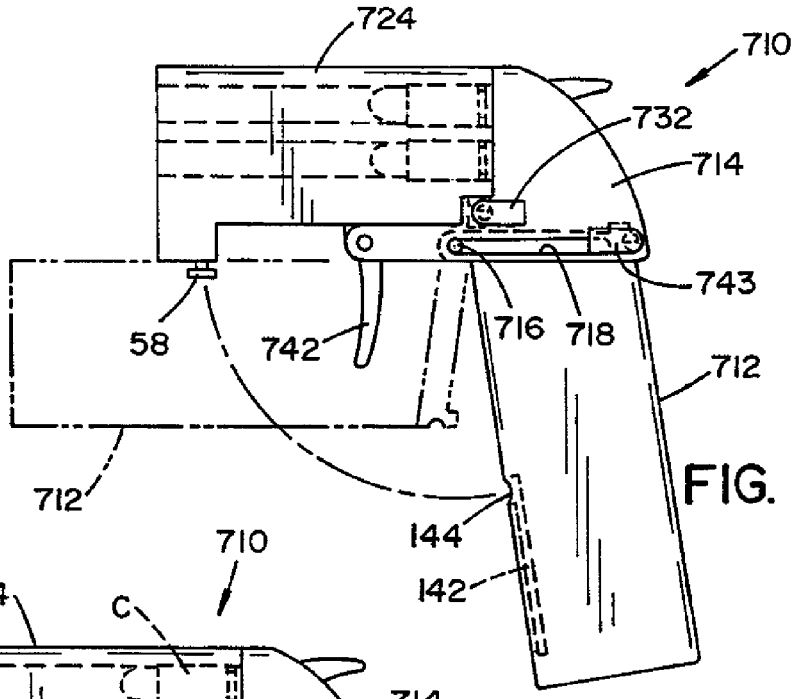
FIG. 17 is a side-elevational view of a double-barrel derringer illustrating another embodiment of the present invention, showing the derringer in an operational configuration.
Figure 18:
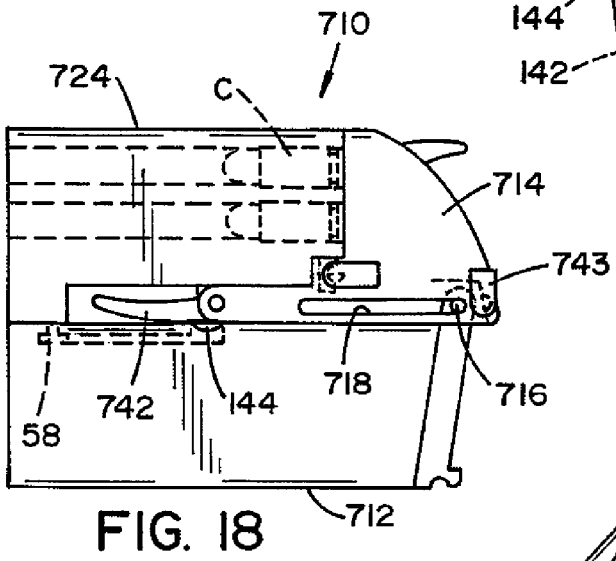
FIG. 18 is a side view of the derringer shown in FIG. 17, showing the derringer in a collapsed, storage configuration.
Figure 19:
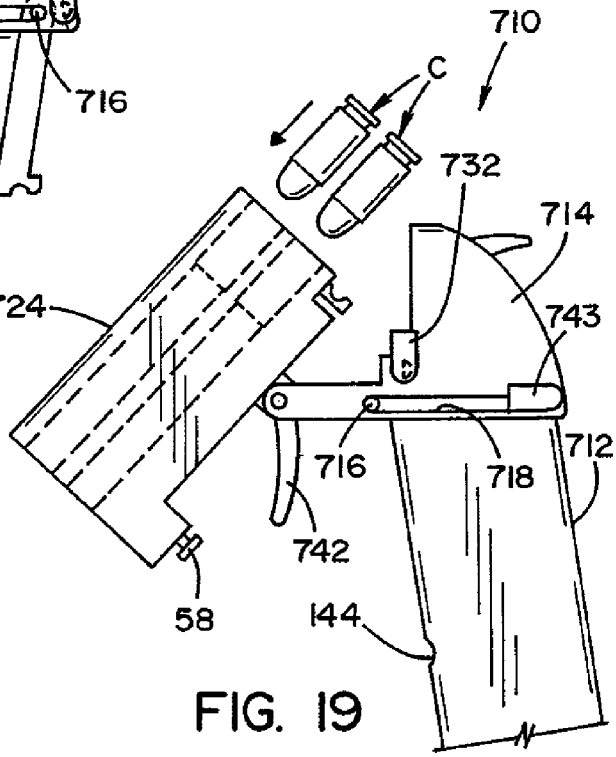
FIG. 19 is a side view of the derringer shown in FIG. 17, showing the derringer opened to allow loading of the derringer.

Referring now to FIGS. 17-19, another embodiment of the present invention is shown. In FIGS. 17-19, a derringer 710 is shown. Designer 710 is collapsible from an operating position as shown in FIG. 17 to a storage position as shown in FIG. 18. In this embodiment, a handgrip 712 is pivotally mounted to a frame 714. Handle 712 is pivotable about a pin 716 that is attached to handgrip 712. Pin 716 is movable in a slot 718 formed in frame 714. In the embodiment shown in FIGS. 17-19, a barrel section 724 is pivotally mounted to frame 714 to allow barrel section 724 to move relative to frame 714 between a closed position (shown in FIG. 17) and an open position (shown in FIG. 19). In the open position, cartridges "C" may be inserted in barrels 724*a*, as illustrated in FIG. 19. A latch 732 movable between a locking and unlocking position is provided for securing and releasing barrel section 724 to frame 714. As with the previous embodiments, a trigger 742 is mounted to frame 714 and is collapsible toward barrel section 724 when handgrip 712 is collapsed toward a storage position, as seen in FIG. 18. A slot 142 is formed in handgrip 712. A circular opening 144 is formed at one end of slot 142 to receive pin 58 on barrel section 724, in a manner as previously described, to secure handgrip 712 to barrel section 724, when derringer 710 is in a storage position. A simple firing mechanism, as is conventionally known, is provided for firing derringer 710. A latch 743 is provided on frame 714 to lock barrel section 724 to frame 712.

Figure 20:
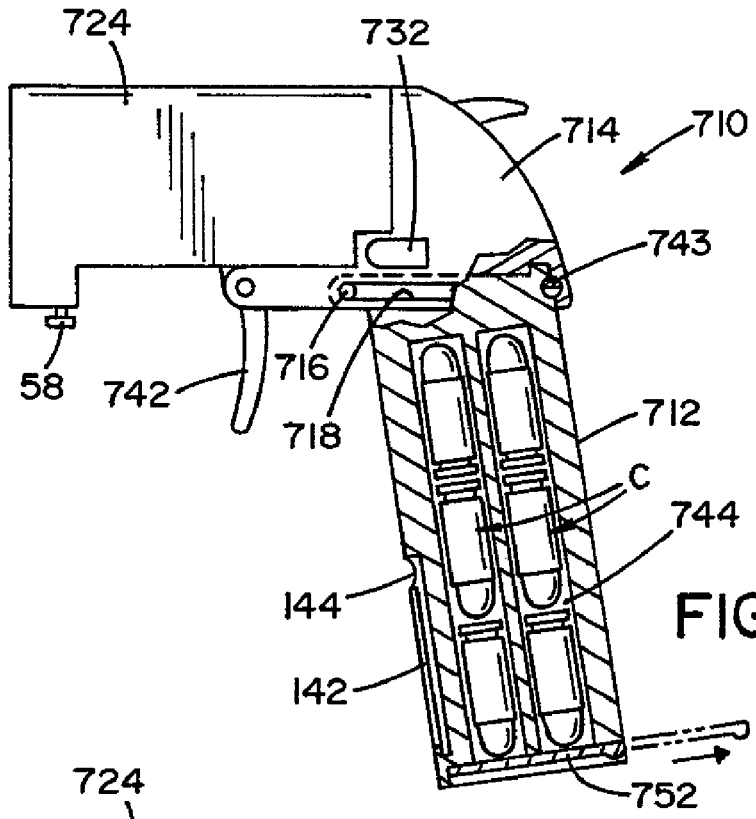
FIG. 20 is a side-elevational view of a derringer of the type shown in FIG. 17, showing a handgrip having an internal storage cavity for additional cartridges.
Figure 21:
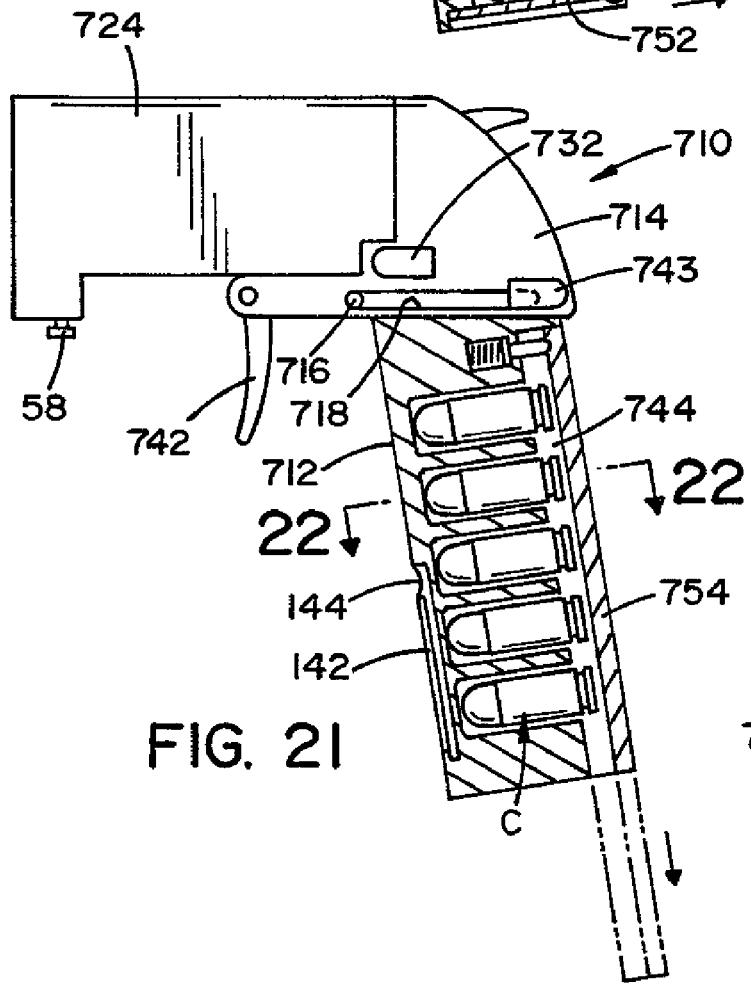
FIG. 21 is a side view of a derringer of the type shown in FIG. 17, showing a handgrip with another type of storage cavity for storage of additional cartridges in the handgrip.
Figure 22:
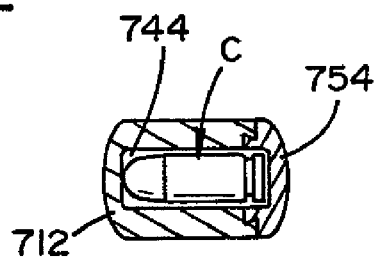
FIG. 22 is a sectional view taken along lines 22-22 of FIG. 21.

FIGS. 20-22 show alternate embodiments of derringer 710. In FIGS. 20-22, storage cavities 744 are formed within handgrip 712 for storing additional cartridges used in derringer 710. In FIG. 20, six (6) cartridges "C" are stored in axial alignment within handgrip 712 of derringer 710. A movable slide 752 is provided on the distal end of handgrip 712 to facilitate access to cartridges "C." In FIG. 21, cartridges "C" are aligned side-by-side in cavities 744 within handgrip 712 of derringer 710. Removable slide portion 754 on the back edge of handgrip 712 is provided for access to the cartridges.

The foregoing description is of a specific embodiment of the present invention. It should be appreciated that this embodiment is described for purposes of illustration only, and that numerous alterations and modifications may be practiced by those skilled in the art without departing from the spirit and scope of the invention. For example, in the embodiment shown in FIGS. 1-16, magazine 120 was removable from the lower, distal end 114 of handgrip 110. It is also contemplated that a magazine may be provided for insertion into handgrip 110 from the proximal end 112 of handgrip 110 when handgrip 110 is in a collapsed position and the cavity in handgrip 110 is exposed. It is also contemplated that handgrip 110 may be designed to comprise a magazine body with a magazine spring and magazine follower incorporated therein, wherein cartridges "C" are inserted into handgrip 110 when handgrip 110 is in a collapsed position. It is intended that all such modifications and alterations be included insofar as they come within the scope of the invention as claimed or the equivalents thereof.

Having described the invention, the following is claimed:

1. A handgun, comprising:

a frame having a barrel, said barrel having a muzzle end and a breech end; and a handgrip attached to said frame, said handgrip being pivotable relative to said frame and movable along the length of said frame.

2. A handgun as defined in claim 1, further comprising an elongated slot in said frame extending along the length of said frame, said handgrip being movable along said slot.

3. A handgun as defined in claim 2, wherein said slot is straight and extends in a direction aligned with said barrel.

4. A handgun as defined in claim 2, wherein said slot has a first end and a second end, said first end being closer to said muzzle end of said barrel than said second end, said handgrip being pivotable relative to said frame when said handgrip is disposed toward said first end of said slot.

5. A handgun as defined in claim 2, wherein said handgrip is pivotable about an axis that extends through said slot.

6. A handgun as defined in claim 2, wherein said handgrip is movable between a firing position and a storage position wherein said handgrip is adjacent said frame.

7. A handgun as defined in claim 2, wherein said handgrip is connected to said frame by a pin extending from said handgrip into said slot.

8. A handgun as defined in claim 7, wherein said pin is located at a first end of said slot when said handgrip is in a firing position and is located at a second end of said slot when said handgrip is in a storage position.

9. A handgun as defined in claim 8, wherein said handgrip is adjacent said frame when said handgrip is in said storage position.

10. A handgun as defined in claim 7, wherein said handgrip is pivotable only when said pin is at one end of said slot.

* * * * *